US008750733B2

(12) United States Patent
Urano

(10) Patent No.: US 8,750,733 B2
(45) Date of Patent: Jun. 10, 2014

(54) FIXING DEVICE AND IMAGE FORMING APPARATUS

(75) Inventor: Etsuaki Urano, Okazaki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 295 days.

(21) Appl. No.: 13/156,515

(22) Filed: Jun. 9, 2011

(65) Prior Publication Data

US 2011/0311250 A1 Dec. 22, 2011

(30) Foreign Application Priority Data

Jun. 21, 2010 (JP) ..... 2010-140933

(51) Int. Cl.
*G03G 15/00* (2006.01)

(52) U.S. Cl.
USPC ..... 399/45

(58) Field of Classification Search
USPC ..... 399/45, 67
See application file for complete search history.

(56) References Cited

U.S. PATENT DOCUMENTS

| | | | | |
|---|---|---|---|---|
| 6,625,417 | B1 | 9/2003 | Terada et al. | |
| 7,369,804 | B2 | 5/2008 | Yasuda et al. | |
| 2004/0136761 | A1 | 7/2004 | Asakura et al. | |
| 2006/0147221 | A1 * | 7/2006 | Asakura et al. | 399/69 |
| 2009/0245902 | A1 | 10/2009 | Gon et al. | |

FOREIGN PATENT DOCUMENTS

| | | | |
|---|---|---|---|
| JP | 2000-181258 | A | 6/2000 |
| JP | 2001-194940 | A | 7/2001 |
| JP | 2003-215957 | A | 7/2003 |
| JP | 2004-86205 | A | 3/2004 |
| JP | 2005-321636 | A | 11/2005 |
| JP | 2005-342985 | A | 12/2005 |
| JP | 2008-074571 | A | 4/2008 |
| JP | 4264086 | B2 | 5/2009 |
| JP | 2009-237402 | A | 10/2009 |
| JP | 2011-053597 | A | 3/2011 |

OTHER PUBLICATIONS

Translation of Kohei (JP, 20011-053597, A, pub date: Mar. 17, 2011).*

Machine translation of JP 2009-239402 (Nanjo), publication date: Oct. 15, 2009.*

Office Action (Notification of Reasons for Refusal) dated Jun. 5, 2012, issued in corresponding Japanese Patent Application No. 2010-140933, and an English Translation thereof (with Verification of Translation). (6 pages).

* cited by examiner

*Primary Examiner* — Walter L Lindsay, Jr.
*Assistant Examiner* — Frederick Wenderoth
(74) *Attorney, Agent, or Firm* — Buchanan Ingersoll & Rooney PC

(57) ABSTRACT

A fixing device for thermally fixing image onto recording sheet by causing recording sheet to pass through fixing nip, while heating electromagnetic induction heating layer provided in heating rotation body by flux generated by flux generator including exciting coil located a distance away from circumferential surface of heating rotation body along width direction of heating rotation body. The flux generator includes: magnetic cores arranged to be separated from each other in width direction, to face heating rotation body via exciting coil; holder holding predetermined magnetic cores, arranged in correspondence with non-paper-pass area of heating rotation body, in displaceable state; displacement unit displacing predetermined magnetic cores in predetermined move unit, which is a unit of one magnetic core or a unit of a predetermined number of consecutively placed magnetic cores; and controller controlling displacement unit to displace predetermined magnetic cores in sequence in predetermined move unit.

19 Claims, 24 Drawing Sheets

FIXING DEVICE AND IMAGE FORMING APPARATUS

This application is based on an application No. 2010-140933 filed in Japan, the contents of which are hereby incorporated by reference.

BACKGROUND OF THE INVENTION (1) Field of the Invention

The present invention relates to a fixing device and an image forming apparatus, and in particular relates to a technology for, in a fixing device that melts toner by heating a heating body in a fixing rotation body by the electromagnetic induction and fixes the melted toner onto a recording sheet, preventing non-paper-pass-through parts in the fixing rotation body from being overheated, while maintaining an appropriate fixing temperature in a paper-pass-through part.

(2) Description of the Related Art

In recent years, an electromagnetic induction heating method has been adopted in a fixing device provided in an image forming apparatus. With the electromagnetic induction heating method, a fixing rotation body (such as a fixing belt or a fixing roller) having an electromagnetic induction heating layer therein is heated by the electromagnetic induction heating with use of an exciting coil. Fixing devices adopting the electromagnetic induction heating method can directly heat the electromagnetic induction heating layer by a flux generated by the exciting coil, thus achieving a high energy efficiency and a short warming-up time.

However, the electromagnetic induction heating layer is formed to be extremely thin so that it has a low heat capacity to achieve a high energy efficiency and a quick warming-up. For this reason, the heat transfer speed in a traverse direction (an axis direction/width direction of the fixing rotation body) perpendicular to the thickness direction of the fixing rotation body is low. When recording sheets of a small size are passed through in continuation, a part of the fixing rotation body over which the recording sheets are passed through (hereinafter referred to as "paper-pass-through part") loses heat, but a part of the fixing rotation body over which the recording sheets are not passed through (hereinafter referred to as "non-paper-pass-through part") does not. This would lead to an overheat of the non-paper-pass-through part (to, for example, 220° C. or more).

When a recording sheet of a large size is passed through while the non-paper-pass-through part of the fixing member is overheated, a problem such as a high-temperature offset due to excessive melting of the toner or uneven gloss may occur. Also, if the fixing device is further heated, PFA (perfluoroalkoxy) tubes covering the fixing roller and a pressure roller may be melted and destroyed.

In view of this, some technologies have been developed to control the amount of heat generated in the non-paper-pass-through part. As one example of such, Japanese Patent Publication No. 4264086 discloses a technology in which a long, cylindrical center core is provided in parallel with a longitudinal direction of an exciting coil, a part of a circumferential surface of the center core corresponding to the non-paper-pass-through part is cut to provide an opening part, and when a fixing is performed on a recording sheet of a small size, the center core is rotated to a position where the opening part faces a heating roller, thereby increasing a distance between the heating roller and the part of the circumferential surface of the center core corresponding to the non-paper-pass-through part of the heating roller, weakening the magnetic link between these, and restricting the heating in the non-paper-pass-through part of the heating roller.

However, the difference in temperature or temperature distribution state between the non-paper-pass-through part and the paper-pass-through part varies depending on the size of the recording sheet passed through, or the number of recording sheets passed through in continuation. Also, when recording sheets of different sizes are passed through in continuation, these differences between the non-paper-pass-through part and the paper-pass-through part vary depending on the combination of sizes of recording sheets, the order in which recording sheets are passed through, or the number of recording sheets passed through for each size. Furthermore, the speed at which the heat transfers from the non-paper-pass-through part having a high temperature to the paper-pass-through part having a low temperature varies depending on the difference in temperature therebetween.

However, according to the structure disclosed in Japanese Patent Publication No. 4264086, the area, in which the distance between the center core and the heating roller is changed, is defined uniformly in correspondence with the non-paper-pass-through part for the currently passed-through recording sheet. With this structure, the difference in temperature distribution between the non-paper-pass-through part and the paper-pass-through part, which occurs due to the difference in the size of the recording sheet passed through, the number of recording sheets passed through, and the order in which recording sheets are passed through, cannot be dealt with flexibly and the temperature may not be controlled appropriately.

SUMMARY OF THE INVENTION

One aspect of the present invention provides a fixing device for thermally fixing an unfixed image onto a recording sheet by causing the recording sheet, with the unfixed image formed thereon, to pass through a fixing nip, while heating an electromagnetic induction heating layer provided in a heating rotation body by a flux generated by a flux generator including an exciting coil located a distance away from a circumferential surface of the heating rotation body along a width direction of the heating rotation body, the flux generator including: a plurality of magnetic cores arranged to be separated from each other in the width direction, to face the heating rotation body via the exciting coil; a holder configured to hold, among the plurality of magnetic cores, predetermined magnetic cores in a displaceable state where the magnetic cores can be displaced in a direction in which a distance from the heating rotation body changes, the predetermined magnetic cores being arranged in correspondence with a non-paper-pass area of the heating rotation body through which a sheet of a predetermined size does not pass; a displacement unit configured to displace the predetermined magnetic cores in a predetermined move unit, the predetermined move unit being a unit of one magnetic core or a unit of a predetermined number of consecutively placed magnetic cores; and a controller configured to control the displacement unit to displace the predetermined magnetic cores in sequence in the predetermined move unit. Another aspect of the present invention provides an image forming apparatus comprising the fixing device having the above characteristics.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 7A illustrates the positional relationships between a cam positioned closest to the center in the width direction and a corresponding arch core; FIG. 7B illustrates the positional relationships between a cam positioned second closest to the center in the width direction and a corresponding arch core; FIG. 7C illustrates the positional relationships between a cam positioned third closest to the center in the width direction and a corresponding arch core; FIG. 7D illustrates the positional relationships between a cam positioned closest to an end in the width direction and a corresponding arch core;

FIG. 9A illustrates the positional relationships between a cam positioned closest to the center in the width direction and a corresponding arch core; FIG. 9B illustrates the positional relationships between a cam positioned second closest to the center in the width direction and a corresponding arch core; FIG. 9C illustrates the positional relationships between a cam positioned third closest to the center in the width direction and a corresponding arch core; FIG. 9D illustrates the positional relationships between a cam positioned closest to an end in the width direction and a corresponding arch core;

FIG. 11A illustrates the positional relationships between a cam positioned closest to the center in the width direction and a corresponding arch core; FIG. 11B illustrates the positional relationships between a cam positioned second closest to the center in the width direction and a corresponding arch core; FIG. 11C illustrates the positional relationships between a cam positioned third closest to the center in the width direction and a corresponding arch core; FIG. 11D illustrates the positional relationships between a cam positioned closest to an end in the width direction and a corresponding arch core;

FIG. 13A illustrates the positional relationships between a cam positioned closest to the center in the width direction and a corresponding arch core; FIG. 13B illustrates the positional relationships between a cam positioned second closest to the center in the width direction and a corresponding arch core; FIG. 13C illustrates the positional relationships between a cam positioned third closest to the center in the width direction and a corresponding arch core; FIG. 13D illustrates the positional relationships between a cam positioned closest to an end in the width direction and a corresponding arch core;

FIG. 15A illustrates the positional relationships between a cam positioned closest to the center in the width direction and a corresponding arch core; FIG. 15B illustrates the positional relationships between a cam positioned second closest to the center in the width direction and a corresponding arch core; FIG. 15C illustrates the positional relationships between a cam positioned third closest to the center in the width direction and a corresponding arch core; FIG. 15D illustrates the positional relationships between a cam positioned closest to an end in the width direction and a corresponding arch core;

FIG. 24A shows the temperature distribution when the change of the arrangement of the arch cores was started; and FIG. 24B shows the temperature distribution when the change of the arrangement of the arch cores was ended.

DESCRIPTION OF THE PREFERRED EMBODIMENTS

Embodiment 1

The following describes an embodiment of the present invention pertaining to the fixing device and the image forming apparatus, taking a tandem color digital printer (hereinafter, merely referred to as "printer") as an example.

(1-1. Overall Structure of Printer)

Figure 1:
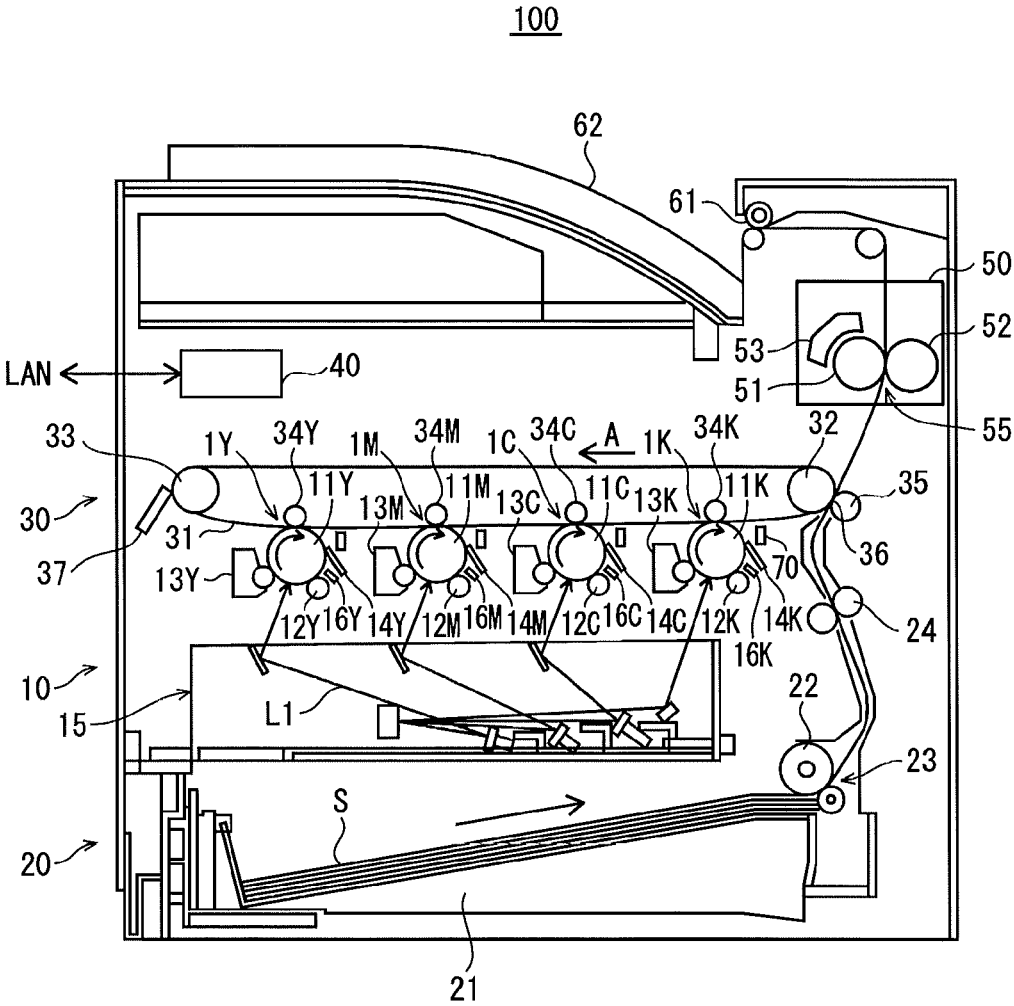
FIG. 1 illustrates the structure of an image forming apparatus in an embodiment of the present invention.

FIG. 1 is a cross-sectional view showing an overall structure of a printer 100 in the embodiment of the present invention. The printer 100 includes an image forming unit 10, a paper feeder 20, a transferring unit 30, a controller 40, and a fixing device 50.

The printer 100 is connected to a network (such as a LAN: Local Area Network). Upon receiving a request to execute a print job from an external terminal device (not illustrated), the printer 100 forms toner images of cyan, magenta, yellow, and black based on the instruction, and forms a full-color image by performing a multi-transfer, namely, by transferring the toner images of these colors.

Hereinafter, the reproduction colors of cyan, magenta, yellow, and black are represented by C, M, Y, and K, respectively, and any structural component related to one of the reproduction colors is represented by a numeral attached with a corresponding character, C, M, Y, or K.

The image forming unit 10 includes image creating units 1C, 1M, 1Y, and 1K, an optical unit 15, an intermediate transfer belt 31, and cleaner blades 14 and 37.

The intermediate transfer belt 31 is an endless belt, suspended with a tension between a drive roller 32 and a passive roller 33, and is driven to move cyclically.

The cleaner blades 14 and 37 are positioned such that the edges thereof contact with a photosensitive drum 11 and the intermediate transfer belt 31, respectively, facing in counter directions, namely in the directions against the rotational directions of the photosensitive drum 11 and the intermediate transfer belt 31, respectively. The cleaner blades 14 and 37 clean the dust, such as remaining toner and paper dust, from the surfaces of the photosensitive drum 11 and the intermediate transfer belt 31, respectively.

The optical unit 15, provided with light-emitting elements such as laser diodes, emit laser beams L1 for forming images of colors C-K in accordance with drive signals received from the controller 40, and expose-scan photosensitive drums 11C-11K. This expose-scanning causes electrostatic latent images to be formed on the photosensitive drums 11C-11K having been charged by chargers 12C-12K. The electrostatic latent images are developed by developing units 13C-13K, and toner images of colors C-K are formed on the photosensitive drums 11C-11K, respectively. The formations of the electrostatic latent images are performed at shifted timings so that the toner images are transferred and layered at the same position on the intermediate transfer belt 31, which is referred to as "first transfer". Toner images of respective colors are transferred onto the intermediate transfer belt 31 in sequence by the electrostatic action of first transfer rollers 34C-34K, and the transferred toner images for the full-color image move toward a second transfer position 36 as the intermediate transfer belt 31 moves.

On the other hand, the paper feeder 20, which includes: a paper feed cassette 21 that houses recording sheets S; a feed roller 22 for feeding the recording sheets S one by one from the paper feed cassette 21 to a transport passage 23; and a pair of timing rollers 24 for adjusting the timing for feeding a recording sheet S to the second transfer position 36, feeds a recording sheet S toward the second transfer position at the timing corresponding to the timing at which the toner images on the intermediate transfer belt 31 are conveyed to the second transfer position. The toner images on the intermediate transfer belt 31 are transferred onto a recording sheet S in block by the action of the second transfer roller 35. This image transfer is referred to as "second transfer".

The recording sheet S having passed through the second transfer position 36 is transported to the fixing unit 50, in which it is heated and pressed when it passes through a fixing nip 55 formed between a fixing roller 51 and a pressing roller 52, so that the toner image (unfixed image) on the recording sheet S is fixed onto the recording sheet S, and the recording sheet S is ejected onto a tray 62 via a pair of ejection rollers 61.

The controller 40 performs communications with external terminals, image processing, and controls to drive the above-described units.

On a front-upper portion of the printer 100, an operation panel 2 (see FIG. 2) is provided at a position where users can easily operate it. The operation panel 2 is provided with, as well as a numerical keypad for inputting the number of copies, a copy start key for indicating a copy start, and a key for selecting an image forming mode, a touch-panel-type liquid crystal display on which a message screen is displayed. The message screen indicates a state of the printer 100, for example, a state where the printer 100 is waiting for a job execution instruction (wait state). The touch panel function of the liquid crystal display is used to receive a selection of a paper feed tray, a copy concentration adjustment or the like.

(1-2. Structure of Controller 40)

Figure 2:
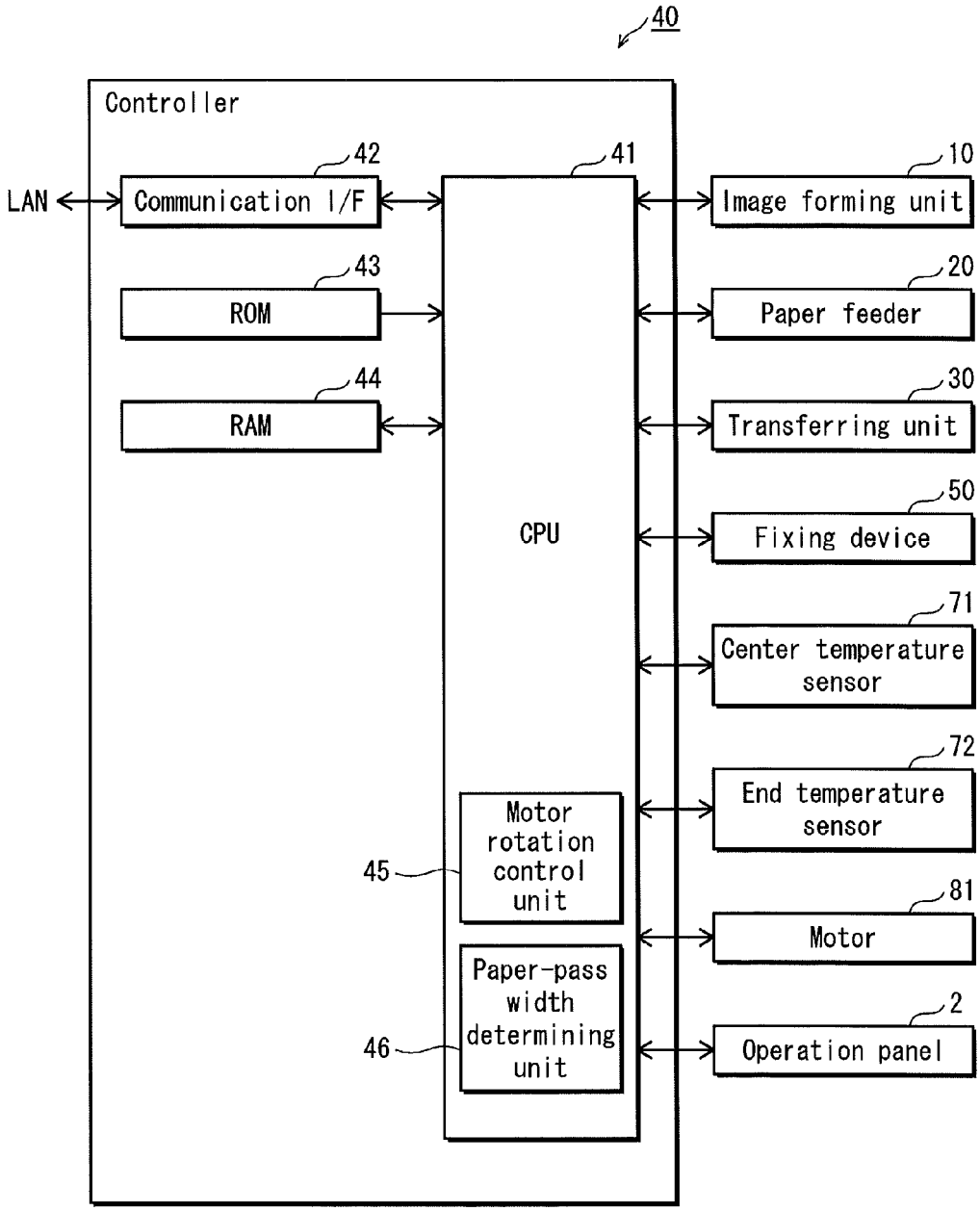
FIG. 2 is a block diagram illustrating the structure of a controller of the image forming apparatus in the embodiment of the present invention.

FIG. 2 is a block diagram illustrating the structure of the controller 40.

As shown in FIG. 2, the controller 40 includes, as main structural elements, a CPU (Central Processing Unit) 41, a communication interface (I/F) 42, a ROM (Read-Only Memory) 43, and a RAM (Random Access Memory) 44.

The communication I/F 42 is an interface, such as a LAN card or a LAN board, which is used to connect to a LAN (Local Area Network) and receive data for a print job from an external device.

The RAM 44 provides a work area used by the CPU 41.

The CPU 41 reads a necessary program from the ROM 43, and controls the operations of the image forming unit 10, paper feeder 20, transferring unit 30, and fixing device 50 in a unified manner at appropriate timings to execute a print job based on the data for the print job received by the communication I/F 42.

A motor rotation control unit 45, as a part of functions provided by the CPU 41, controls the rotation of a motor 81.

A paper-pass width determining unit 46, as a part of functions provided by the CPU 41, determines the size of a recording sheet on which an image is to be formed (paper-pass width), based on the header information of the print job data received by the communication I/F 42, or information of a selected recording sheet (paper feed tray) input by the user on the operation panel 2.

The CPU 41 also controls the heat of an electromagnetic induction heating layer 514 (see FIG. 4) of the fixing roller 51 by displacing arch cores (magnetic cores) 532 (see FIG. 3) by instructing the motor rotation control unit 45 to cause the motor 81 to rotate, based on a surface temperature of the fixing roller 51 detected by a center temperature sensor 71 or an end temperature sensor 72, or based on a paper-pass width determined by the paper-pass width determining unit 46. Details of this will be described later.

(1-3. Structure of Fixing Device 50)

Figure 3:
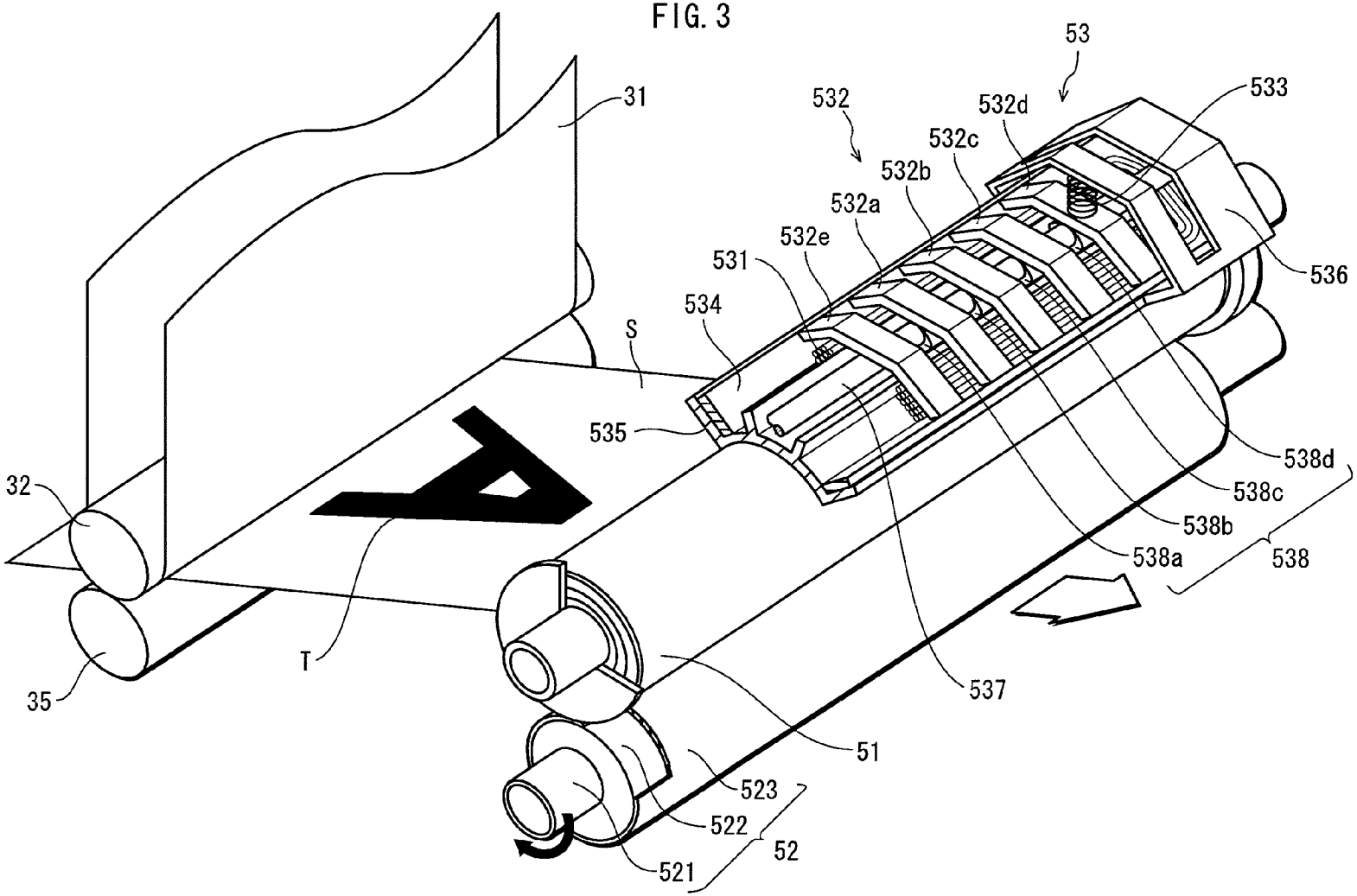
FIG. 3 is a partial cross sectional perspective view of a fixing device in the embodiment of the present invention.
Figure 4:
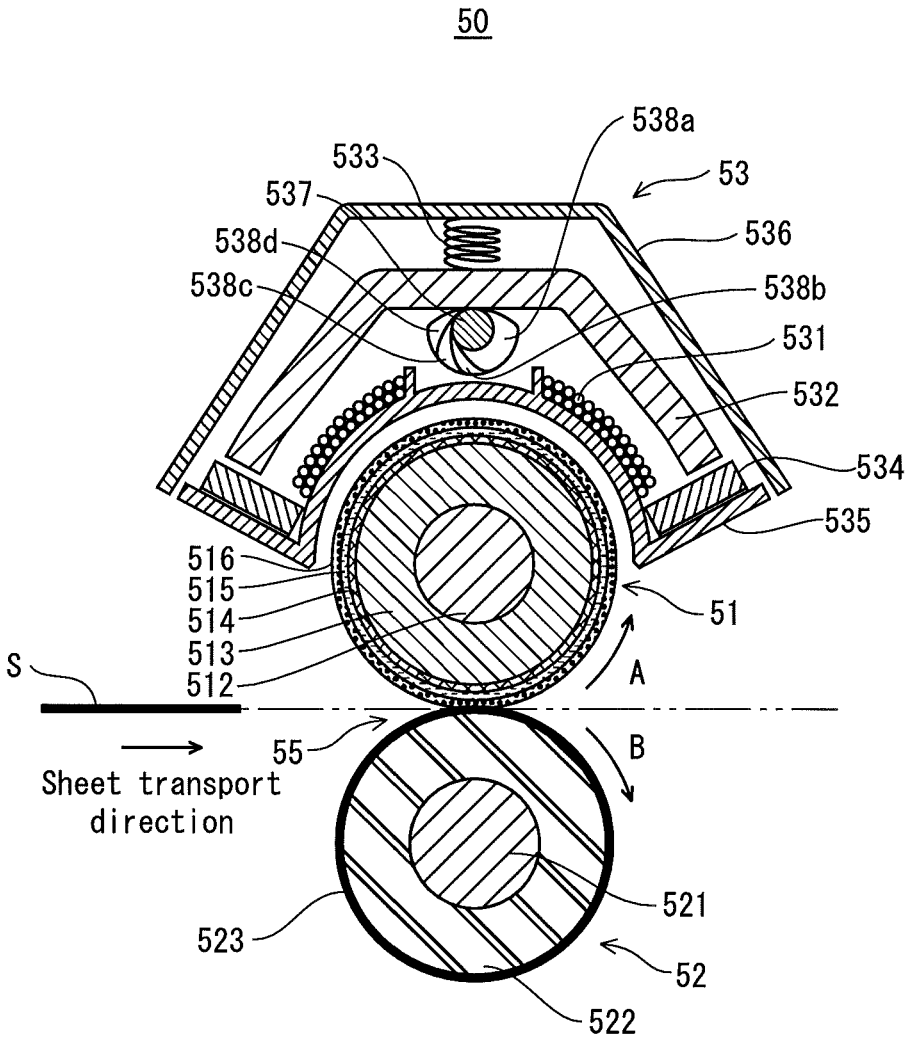
FIG. 4 is a cross sectional view illustrating the structure of the fixing device in the embodiment of the present invention.

FIG. 3 is a partial cross sectional perspective view of the fixing device 50. FIG. 4 is a transverse sectional view of the main part thereof. Note that FIGS. 3 and 4 illustrate the fixing device 50 having been rotated clockwise by approximately 45° from its posture shown in FIG. 1.

As shown in FIGS. 3 and 4, the fixing device 50 includes the fixing roller 51, the pressing roller 52, a flux generator 53 and the like.

The fixing roller 51 and the pressing roller 52 are arranged in parallel with each other. The pressing roller 52 is urged toward the fixing roller 51 by an urging mechanism (not illustrated), so that the fixing nip 55 is formed between the rollers 51 and 52. When the recording sheet S passes through the fixing nip 55, it is heated and pressed and a toner image T having been formed on the recording sheet S is melted and fixed onto the recording sheet S.

In the following, particular parts will be described in detail.

<Flux Generator>

The flux generator 53 for generating an alternating magnetic field toward the fixing roller 51 includes an exciting coil 531, arch cores 532, compression springs 533, hem cores 534, a coil bobbin 535, a cover 536, a rotation shaft 537, and cams 538, and is arranged along the axis direction (width direction) of the fixing roller 51.

The coil bobbin 535 is made of an insulation material such as a resin. The inside of the coil bobbin 535 has a ring-like groove in which the exciting coil 531 is housed when it is wound around the coil bobbin 535. The side of the coil bobbin 535 facing the fixing roller 51 has been formed in a shape of an arc along the circumferential surface of the fixing roller 51. The coil bobbin 535 is fixed at both ends thereof by frames or the like (not illustrated) so that a gap of, for example, 2 [mm] is formed between the coil bobbin 535 and the circumferential surface of the fixing roller 51.

The exciting coil 531 is, for example, a litz wire that is a bundle of 100 copper lines each being 0.17 [mm] in outer diameter, wherein the surfaces of the copper lines have been processed to be insulating. The exciting coil 531 is covered with a heat-resistant resin (not illustrated), extends along the width direction of the recording sheet S, and is wound around the coil bobbin 535, for example, ten times to be in a shape of an arc in a transverse section as shown in FIG. 4. The exciting coil 531 is connected with an exciting coil drive circuit including a known high-frequency inverter (not illustrated), and generates a flux by an alternating-current power supplied from the exciting coil drive circuit, thereby heating the electromagnetic induction heating layer 514 of the fixing roller 51.

The arch cores 532 are in a shape of an arc which is smooth or has angles in a cross section taken along a plane perpendicular to the axis of the fixing roller 51. The arch cores 532 are arranged at regular intervals in the axis direction of the fixing roller 51 so that the arch opening sides of the arch cores 532 are along the circumferential surface of the fixing roller 51.

Figure 10:
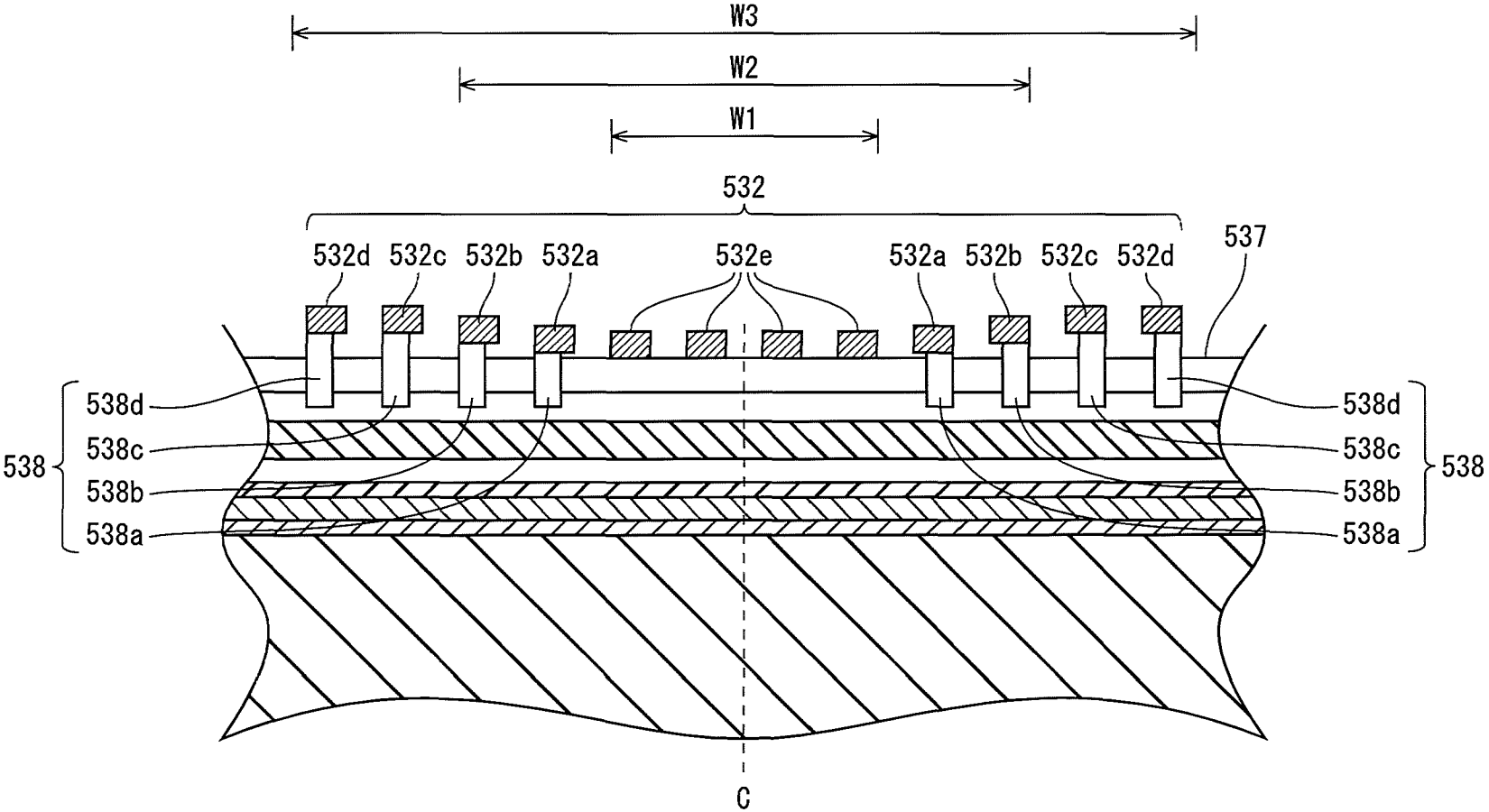
FIG. 10 is a partial cross sectional view illustrating the positional relationships between arch cores in the third stage in the fixing device in the embodiment of the present invention.

There are 12 arch cores 532 which are arranged at regular intervals along the width direction of the fixing roller 51. As shown in FIG. 10, four arch cores 532*e* are arranged within a minimum paper-pass width W1 (an area through which a sheet of a predetermined size can pass) which extends on both sides of the center (represented by the dotted line C) in the width direction of the fixing roller 51. Pairs of arch cores 532*a*, 532*b*, 532*c*, and 532*d* are arranged in areas (areas through which the sheet of the predetermined size cannot pass) on both sides of the arch cores 532*e* in the stated order from the center in the width direction of the fixing roller 51 such that two arch cores making each pair are distributed in respective two areas on both sides of the arch cores 532*e* (see FIGS. 6 and 10).

Pairs of cams 538*a*, 538*b*, 538*c*, and 538*d* are provided on the circumferential surface of the rotation shaft at positions corresponding to the pairs of arch cores 532*a*, 532*b*, 532*c*, and 532*d*, respectively.

Note that, when there is no need to distinguish the arch cores 532*e*, 532*d*, 532*c*, 532*b*, and 532*a* from each other, they are generically called "arch cores 532".

Also, when there is no need to distinguish the cams 538*a*, 538*b*, 538*c*, and 538*d* from each other, they are generically called "cams 538".

Note that in FIG. 3, only five arch cores 532 and four cams 538 in one end in the axis direction of the fixing roller 51 are shown.

The rotation shaft 537 is a cylindrical member provided between the arch cores 532 and the ring-like groove of the coil bobbin 535 along the width direction of the fixing roller 51, and is held to be rotatable, by bearing (not illustrated) provided at both ends in the width direction of the coil bobbin 535.

Pairs of cams 538*a*, 538*b*, 538*c*, and 538*d* are provided on the circumferential surface of the rotation shaft at positions corresponding to the pairs of arch cores 532*a*, 532*b*, 532*c*, and 532*d* in the width direction of the rotation shaft 537 to displace the arch cores 532*a*, 532*b*, 532*c*, and 532*d* when the rotation shaft 537 rotates. This will be described in detail later.

The arch cores 532, rotation shaft 537, and hem cores 534 are each made of a magnetic body having a high magnetic permeability such as ferrite, and guide the flux generated by the exciting coil 531 to the fixing roller 51. Note that in the present application, the term "magnetic body" is used to refer to a ferromagnetic body except when otherwise noted.

The cams 538 are made of a heat-resistant nonmagnetic body, for example, a resin such as PI (polyimide), PEEK (polyetheretherketone), or PPS (polyphenylenesulfide). Note that in the present application, the term "nonmagnetic body" is used to refer to a material that is not a ferromagnetic body except when otherwise noted.

The flux guided onto the surface of the fixing roller 51 mainly passes through a portion of the electromagnetic induction heating layer 514 of the fixing roller 51 facing the flux generator 53, which sets up eddy currents in the portion to heat the electromagnetic induction heating layer 514. The heat generated here is conveyed to the pressing roller 52 through the fixing nip 55 when the fixing roller 51 is rotated, thus increasing the temperature in the fixing nip 55.

The cover 536, made of an insulation material such as a resin, is a cover of the coil bobbin 535 that houses the hem cores 534, exciting coil 531, arch cores 532 and the like.

<Fixing Roller>

The fixing roller 51 includes: a cored bar 512 which is a hollow or solid cylinder and is, for example, 20 [mm] in outer diameter; and an elastic layer 513 formed on the circumferential surface of the cored bar 512. The fixing roller 51 also includes the electromagnetic induction heating layer 514, an elastic layer 515, and a releasing layer 516 that are laminated on the circumferential surface of the elastic layer 513 in this order.

The fixing roller 51 is held at bearing-contact portions formed in both ends of the cored bar 512, by bearings such as ball bearings provided in the frames (not illustrated).

The cored bar 512 is made of stainless or the like. The elastic layer 513 is made of a highly heat-insulating elastic material such as a silicone sponge rubber, and is, for example, 10 [mm] in thickness.

The electromagnetic induction heating layer 514 is made of nickel or the like, and is, for example, 40 [μm] in thickness. The electromagnetic induction heating layer 514 produces heat when the flux generator 53 generates a flux.

The elastic layer 515 is made of a heat-resistant silicone rubber or the like, and is, for example, 0.3 [mm] in thickness. The elastic layer 515 has a role of increasing the contact between the recording sheet S and the surface of the fixing roller 51.

The releasing layer 516, the outermost layer, is a tube made of PFA (copolymer of tetrafluoroethylene and perfluoroalkoxyethylene), and is, for example, 30 [μm] in thickness. The releasing layer 516 has a role of increasing the releasability of the surface of the fixing roller 51.

<Pressing Roller>

The pressing roller 52 includes a cylindrical cored bar 521 that is, for example, 26 [mm] in outer diameter. The pressing roller 52 also includes an elastic layer 522 and a releasing layer 523 that are laminated on the circumferential surface of the cylindrical cored bar 521 in this order. The pressing roller 52 is pressed against the fixing roller 51 by a pressing member having a spring or the like (not illustrated) to form the fixing nip 55 therebetween. The cored bar 521 is made of stainless or the like. The elastic layer 522 is made of a silicone rubber, a silicone sponge rubber or the like, and is, for example, 4 [mm] in thickness. The releasing layer 523 is a tube made of PFA, PTFE (polytetrafluoroethylene) or the like, and is, for example, 30 [μm] in thickness.

The pressing roller 52 is held in a rotatable state at both ends of the cored bar 521 in the axis direction, by bearings provided in the frames (not illustrated), and is driven to rotate in the direction indicated by the arrow B by a driving force received from a driving motor (not illustrated). With the rotation of the pressing roller 52, the fixing roller 51 rotates passively in the direction indicated by the arrow A.

Figure 5:
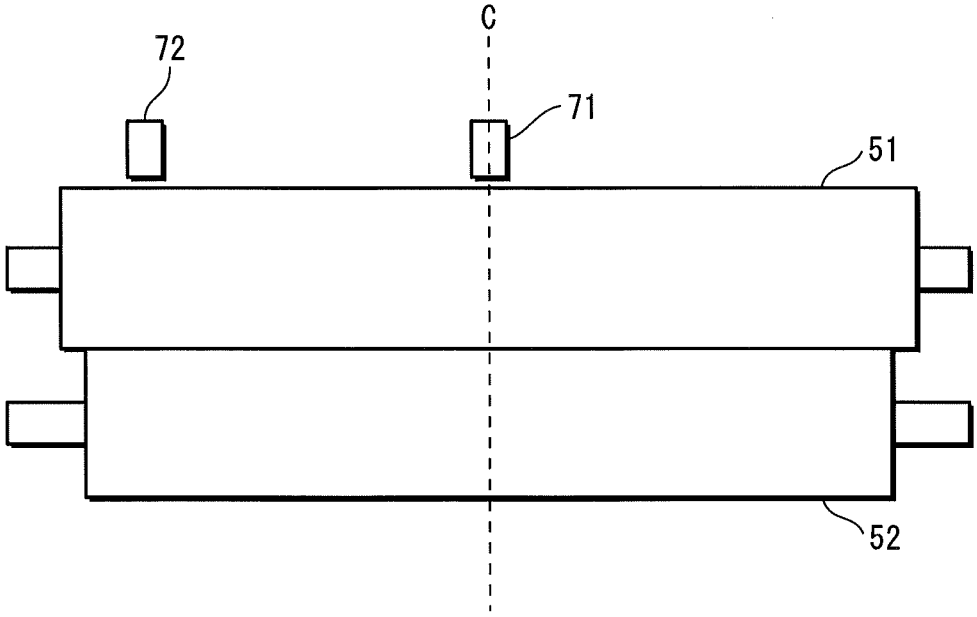
FIG. 5 is a side view illustrating positional relationships between a temperature sensor and a fixing roller in the fixing device in the embodiment of the present invention.

Also, as shown in FIG. 5, the fixing device 50 is provided with the center temperature sensor 71 and the end temperature sensor 72 which detect the surface temperatures of the fixing roller 51 at the center and in the vicinity of an end in the width direction of the fixing roller 51. The controller 40 detects the current temperature of the fixing roller 51 from the detection signals received from these censors.

The fixing device 50 adopts a method in which it causes the recording sheet S to pass through the rollers with reference to the center of the fixing roller 51 in the width direction indicated by the dotted line C, to fix a toner image on the sheet (hereinafter, the method is referred to as "center paper-pass"). A predetermined area which includes the center in the width direction and through which the recording sheet S passes is referred to as "paper-pass-through part", and areas positioned at both sides of the paper pass-through area in the width direction of the fixing roller 51 through which the recording sheet S does not pass are referred to as "non-paper-pass-through parts". The predetermined area defining the paper-pass-through part is determined based on the size (paper-pass width) of the recording sheet S that is to be passed through there.

The center temperature sensor 71 and the end temperature sensor 72 are non-contact-type temperature sensors. More specifically, they are, for example, infrared temperature sensors using thermopiles.

(1-4. Displacement Mechanism of Arch Cores 532)

The following describes a mechanism for displacing the arch cores 532.

Figure 6:
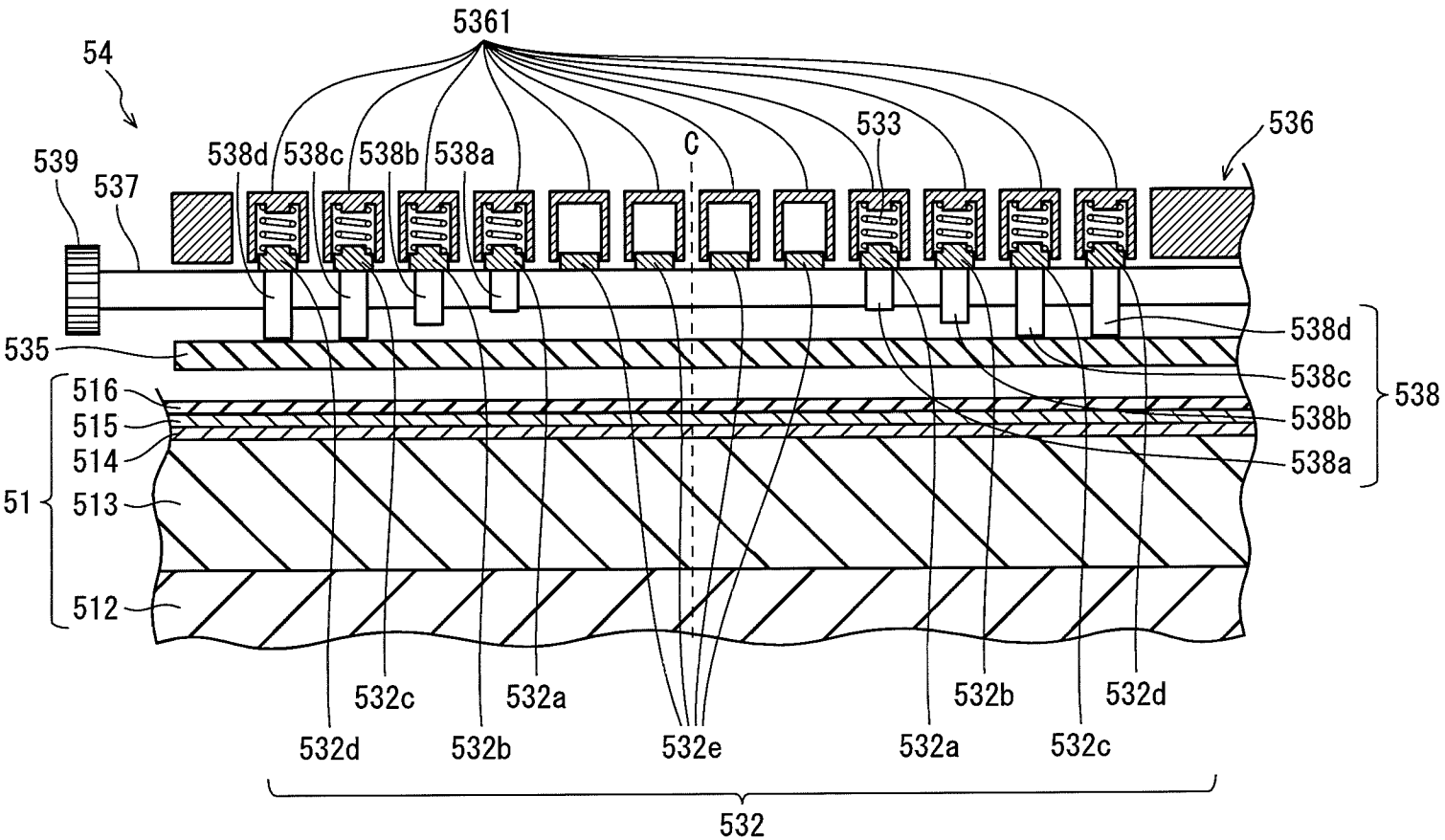
FIG. 6 is a partial cross sectional view illustrating arch cores and the structure of an arch cores displacement mechanism in the fixing device in the embodiment of the present invention, indicating positional relationships between arch cores in the first stage.

FIG. 6 is a partial cross sectional view taken along a plane passing through the axes of the fixing roller 51 and rotation shaft 537 of the fixing device 50 shown in FIG. 4. A gear 539 is attached to one end of the rotation shaft 537. The rotation shaft 537 is driven to rotate by a driving force received from the motor 81 (see FIG. 2) via the gear 539. Note that, in FIG. 6, with regard to the rotation shaft 537, cams 538, and gear 539, the side views, not the cross-sectional views, are shown.

A part of the cover 536 is sectioned into core cases 5361 whose surfaces on the side of the coil bobbin 535 are opened. In each of the core cases 5361, an arch core 532 is housed in the state where the arch core 532 can be displaced toward a direction determined by a change of the distance from the fixing roller 51. In the core cases 5361, in which the arch cores 532*a*, 532*b*, 532*c*, and 532*d* are housed, compression springs 533 being elastic members are housed as well, one for each core case. The compression springs 533 urge the arch cores 532*a*, 532*b*, 532*c*, and 532*d* toward the rotation shaft 537, respectively. No compression springs 533 are provided in the core cases 5361 housing the arch cores 532*e*. The arch cores 532*e* are fixed to the respective core cases 5361 and are not displaced.

The core cases 5361 and the compression springs 533 constitute a holder for holding the arch cores 532 in the state where the arch cores 532 can be displaced.

Figure 7A:
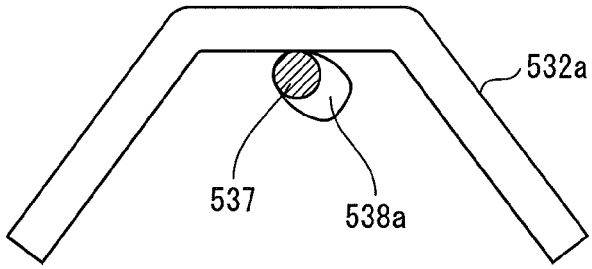
FIGS. 7A through 7D are cross sectional views illustrating the positional relationships between the cams and corresponding arch cores in the first stage when the device is viewed from the axis direction.
Figure 7B:
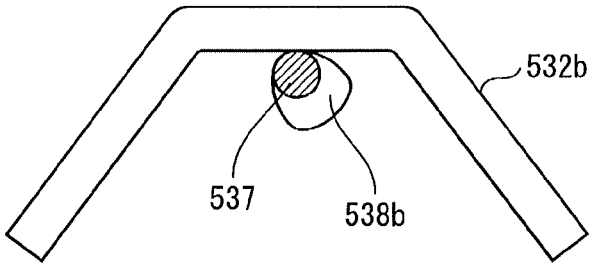
Figure 7C:
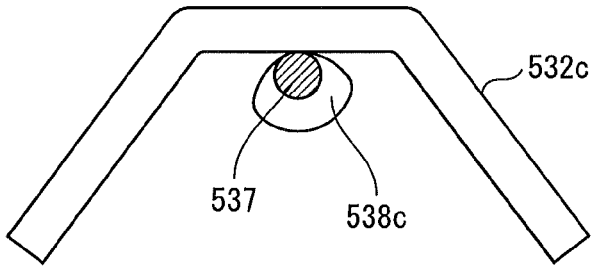
Figure 7D:
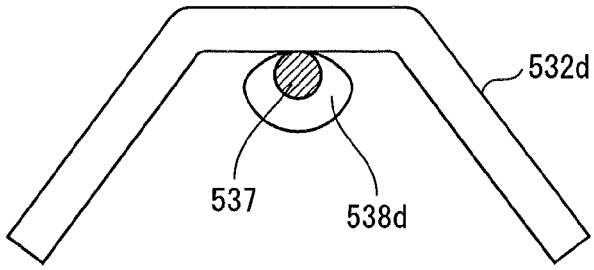

FIGS. 7A through 7D are cross sectional views illustrating the positional relationships between the cams 538 and the arch cores 532 when the device in the state illustrated in FIG. 6 (hereinafter, the arrangement of the arch cores 532 in this state is referred to as "first stage") is viewed from the axis direction. FIG. 7A illustrates the positional relationships between a cam 538*a* and an arch core 532*a*. FIG. 7B illustrates the positional relationships between a cam 538*b* and an arch core 532*b*. FIG. 7C illustrates the positional relationships between a cam 538*c* and an arch core 532*c*. FIG. 7D illustrates the positional relationships between a cam 538*d* and an arch core 532*d*. In FIG. 4, the cams 638 are indicated in the state where they overlap with each other, and the shape of each cam is not clear. In contrast, FIGS. 7A through 7D clearly show the shape of each cam. As shown in FIGS. 7A through 7D, the cams 538*a* through 538*d* are each, in a cross section taken along a plane perpendicular to the axis direction, in a shape of an approximate fan which is obtained by removing a part of an approximate circle, wherein the center of each fan shape matches a circumferential surface of the rotation shaft 537. The angle at the center of the fan shape increases in the order of cam 538*a*, cam 538*b*, cam 538*c*, and cam 538*d*. The counterclockwise sides of these fan shapes are identical with each other when viewed from the axis direction. The fan shapes are attached to the rotation shaft at positions having the same rotation angle of the rotation shaft.

Note that the counterclockwise sides of the fan shapes of the 538*a*, 538*b*, 538*c*, and 538*d* may not necessarily be identical with each other when viewed from the axis direction as far as the cam surfaces of all the cams are in contact with the arch cores 532 at the same time at a predetermined rotation angle of the rotation shaft, and when, as shown in FIG. 7D, the cam 538*d* is in contact with the arch core 532*d* at the center of the fan shape whose circumferential surface matches the circumferential surface of the rotation shaft 537, the cams 538*a*, 538*b*, and 538*c* are in contact with the arch cores 532*a*, 532*b*, and 532*c* at the respective centers of the fan shapes.

As shown in FIGS. 7A through 7D, in the first stage, the cams 538*a* through 538*d* contact with the arch cores 532*a* through 532*d*, respectively, at the portion in the center of each fan shape that matches a circumferential surface of the rotation shaft 537. In the first stage, each cam is positioned closest to the fixing roller 51, namely, the electromagnetic induction heating layer 514. Hereinafter, the position where the cam is closest to the electromagnetic induction heating layer 514 is referred to as "closest position" (first position).

The cams 538*a* through 538*d* rotate as the rotation shaft 537 rotates. This causes a circumferential surface of a fan shape at its arc (hereinafter referred to as "cam surface") to contact with an arch core 532 and displace the arch core 532 in a direction along which the compression spring 533 is compressed. At this time, since the central angles of the fan shapes of the cams 538 are different from each other, the rotation angles of the rotation shaft 537 at which the cam surfaces are in contact with the arch cores 532 are different, as well. Accordingly, the arch cores 532 are displaced at different degrees depending on the rotation angle of the rotation shaft.

The rotation shaft 537, cams 538, gear 539, and motor 81 constitute an arch core displacement unit 54 functioning as means for displacing the arch cores 532.

Figure 8:
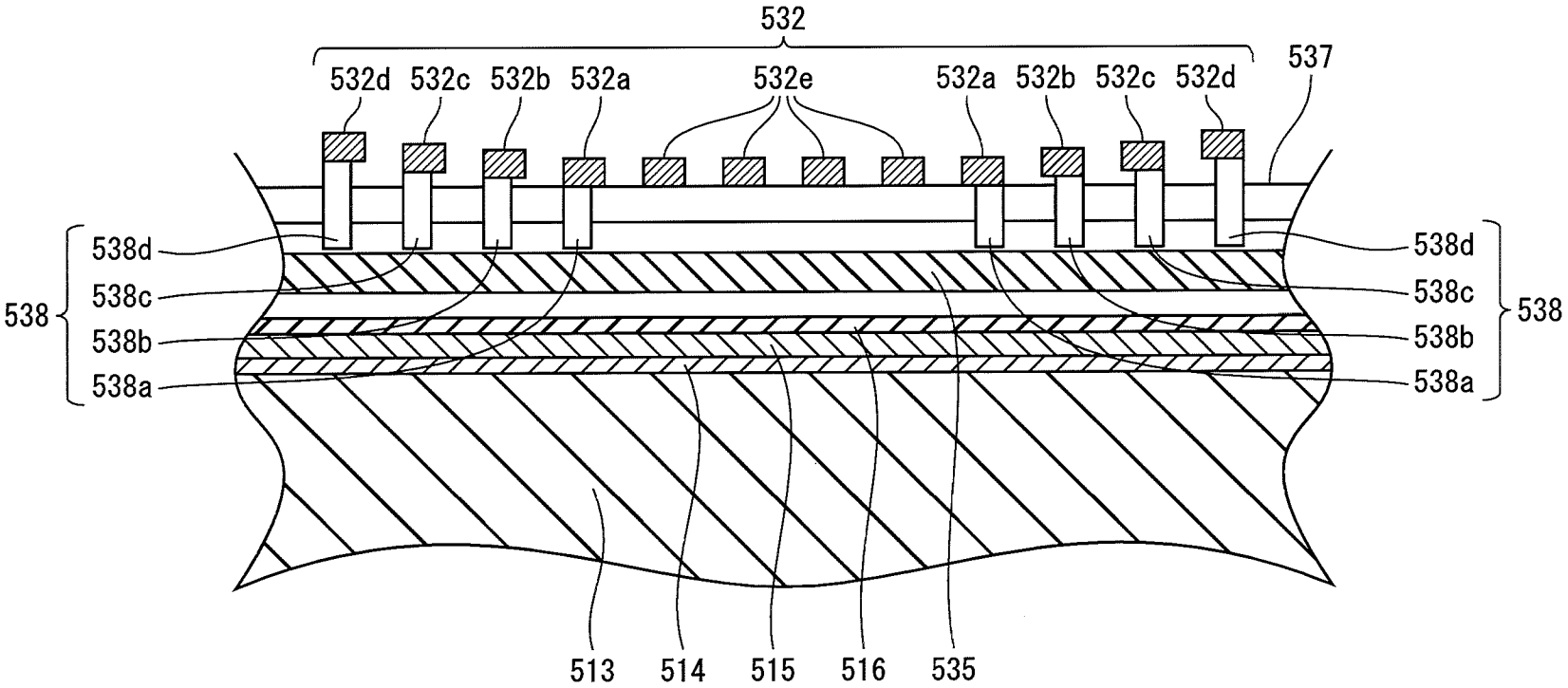
FIG. 8 is a partial cross sectional view illustrating the positional relationships between arch cores in the second stage in the fixing device in the embodiment of the present invention.

FIG. 8 is a partial cross sectional view taken along a plane passing through the axes of the fixing roller 51 and rotation shaft 537 of the fixing device 50, showing a state of the fixing device 50 after the rotation shaft 537 is rotated clockwise by approximately 90° from the first stage. Note that, in FIG. 8, with regard to the rotation shaft 537, cams 538, and gear 539, the side views, not the cross-sectional views, are shown and the cover 536 and compression springs 533 are omitted. This also applies to FIGS. 10, 12 and 14.

Figure 9A:
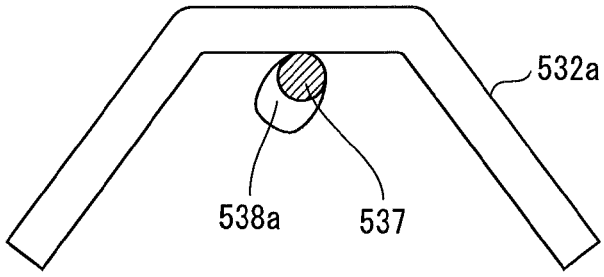
FIGS. 9A through 9D are cross sectional views illustrating the positional relationships between the cams and corresponding arch cores in the second stage when the device is viewed from the axis direction.
Figure 9B:
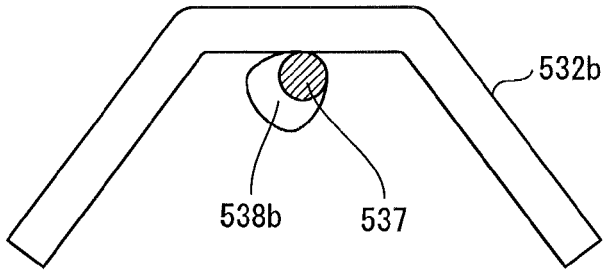
Figure 9C:
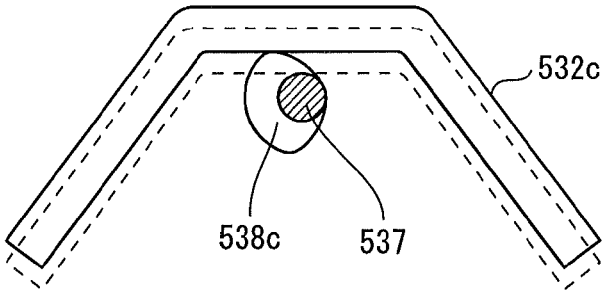
Figure 9D:
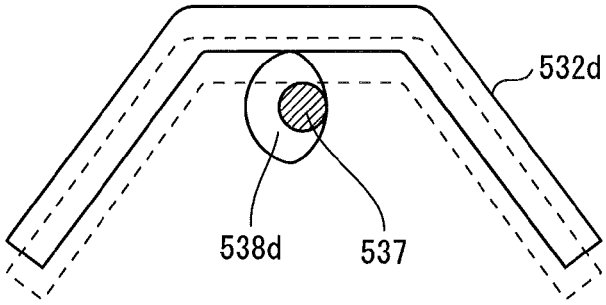

FIGS. 9A through 9D are cross sectional views illustrating the positional relationships between the cams 538 and the arch cores 532 when the device in the state illustrated in FIG. 8 (hereinafter, the arrangement of the arch cores 532 in this state is referred to as "second stage") is viewed from the axis direction. FIG. 9A illustrates the positional relationships between the cam 538*a* and the arch core 532*a*. FIG. 9B illustrates the positional relationships between the cam 538*b* and the arch core 532*b*. FIG. 9C illustrates the positional relationships between the cam 538*c* and the arch core 532*c*. FIG. 9D illustrates the positional relationships between the cam 538*d* and the arch core 532*d*.

As shown in FIG. 8 and FIGS. 9A through 9D, in the second stage, the cam surfaces of the cams 538*d*, which are, among the cams 538, located closest to both ends of the fixing roller 51 in its width direction, are in contact with the arch cores 532*d*. This displaces the arch cores 532*d* in a direction moving away from the electromagnetic induction heating layer 514. Hereinafter, the position at which the arch cores 532 are a distance away from the electromagnetic induction heating layer 514 is referred to as "distant position" (second position). At this time, a circumferential surface of a side of the fan shape of each cam 538*c* is in contact with an arch core 532*c*, displacing the arch core 532*c* to a position in the middle of the closest position and the distant position.

Note that the amount of displacement between the closest position and the distant position is, for example, in a range from 2 [mm] to 3 [mm].

Displacement of an arch core 532 to the distant position increases the distance between the arch core 532 and the electromagnetic induction heating layer 514, and elongates the flux path that passes through the arch core 532. This increases the magnetic resistance, thereby reducing the amount of heat generated in the electromagnetic induction heating layer 514 by the flux passing through the arch core 532.

Also, when an arch core 532 is at the distant position, a corresponding cam 538, a nonmagnetic body, is located between the arch core 532 and the electromagnetic induction heating layer 514, and the cam 538 restricts the magnetic link between the arch core 532 and the electromagnetic induction heating layer 514, resulting in an effective restriction of the heat generated in the electromagnetic induction heating layer 514.

FIG. 10 is a partial cross sectional view taken along a plane passing through the axes of the fixing roller 51 and rotation shaft 537 of the fixing device 50, showing a state of the fixing device 50 after the rotation shaft 537 is rotated clockwise by approximately 45° from the second stage.

Figure 11A:
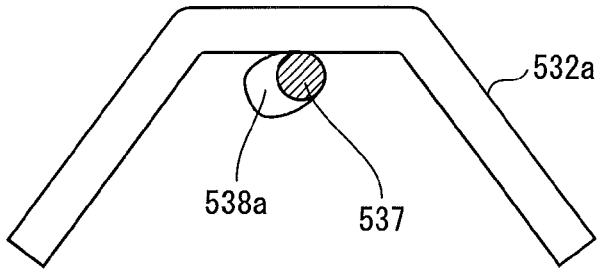
FIGS. 11A through 11D are cross sectional views illustrating the positional relationships between the cams and corresponding arch cores in the third stage when the device is viewed from the axis direction.
Figure 11B:
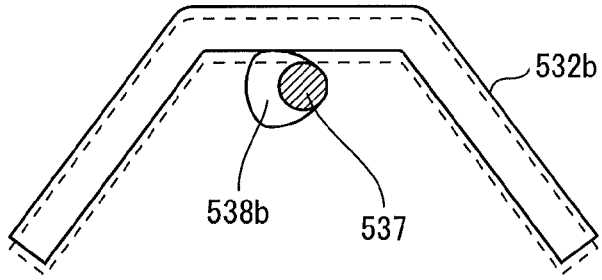
Figure 11C:
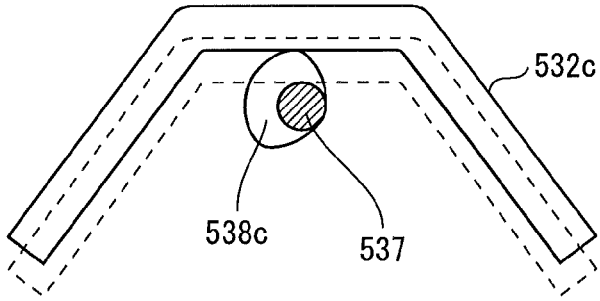
Figure 11D:
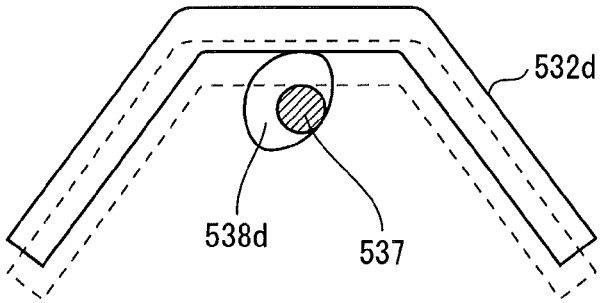

FIGS. 11A through 11D are cross sectional views illustrating the positional relationships between the cams 538 and the arch cores 532 when the device in the state illustrated in FIG. 10 (hereinafter, the arrangement of the arch cores 532 in this state is referred to as "third stage") is viewed from the axis direction. FIG. 11A illustrates the positional relationships between the cam 538*a* and the arch core 532*a*. FIG. 11B illustrates the positional relationships between the cam 538*b* and the arch core 532*b*. FIG. 11C illustrates the positional relationships between the cam 538*c* and the arch core 532*c*. FIG. 11D illustrates the positional relationships between the cam 538*d* and the arch core 532*d*.

As shown in FIG. 10 and FIGS. 11A through 11D, in the third stage, the cam surfaces of the cams 538*d* and 538*c*, which are, among the cams 538, located first and second closest to both ends of the fixing roller 51 in its width direction, are in contact with the arch cores 532*d* and 532*c*. This displaces the arch cores 532*d* and 532*c* to the distant position. At this time, a circumferential surface of a side of the fan shape of each cam 538*b* is in contact with an arch core 532*b*, displacing the arch core 532*b* to a position in the middle of the closest position and the distant position.

As shown in FIG. 10, arch cores up to arch cores 532*b* on both sides of the center (represented by the dotted line C) in the width direction of the fixing roller 51 are arranged within an A4 vertical paper passing portion (a paper-pass width W2=210 [mm]). Accordingly, the third stage in which the arch cores 532*c* and 532*d* have been displaced to the distant position represents a predetermined arrangement of the arch cores 532 for passing a sheet of A4 paper vertically.

Note that in the present embodiment, the minimum paper-pass width W1 is set to 105 [mm] (A5 vertical: the predetermined size), and the maximum paper-pass width W3 is set to 297 [mm] (A4 horizontal, A3 vertical). The arch cores 532*e*, which are not displaced, are arranged within the minimum paper-pass width W1 for passing a sheet of A5 paper vertically (an area through which a sheet of the predetermined size passes), and the arch cores 532*a*, 532*b*, 532*c*, and 532*d*, which can be displaced, are arranged in areas through which the A5 vertical paper cannot pass (an area through which a sheet of the predetermined size does not pass). Note that the minimum paper-pass width W1 for passing a sheet of the predetermined size is not limited to the A5 vertical size, but may be another size, for example, a postcard size, depending on the usage.

Figure 12:
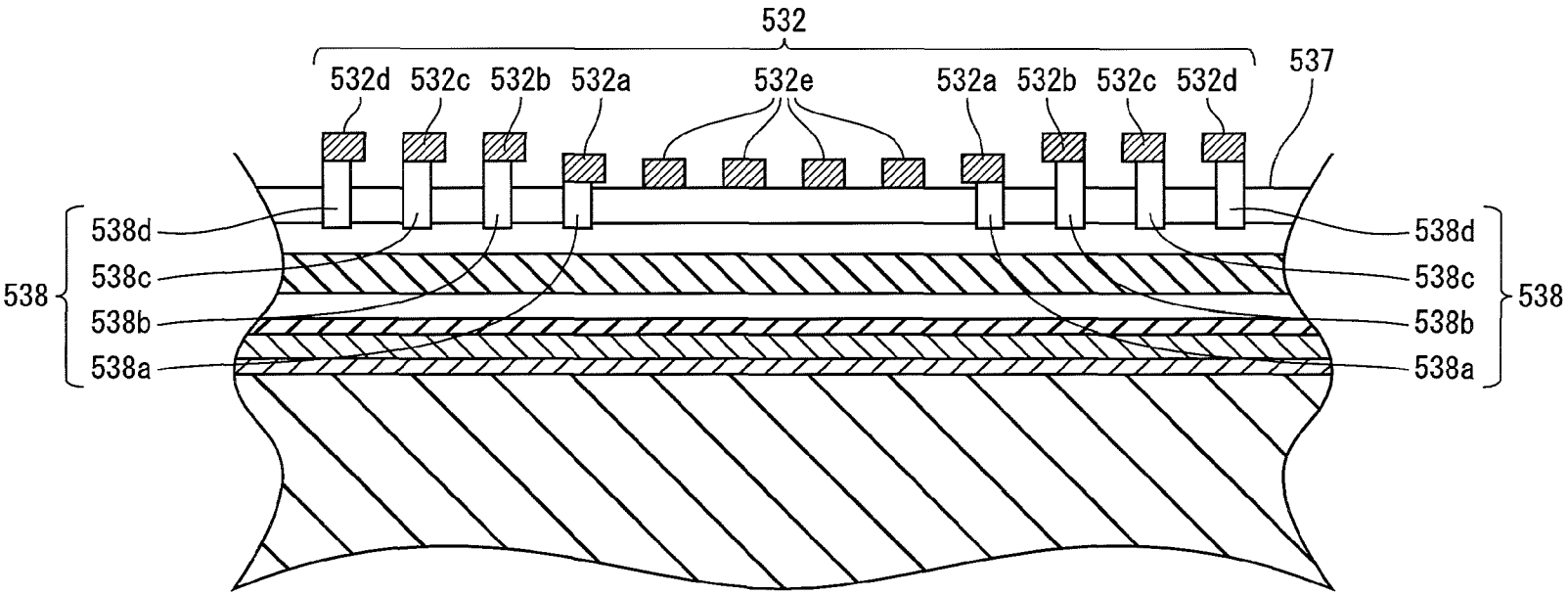
FIG. 12 is a partial cross sectional view illustrating the positional relationships between arch cores in the fourth stage in the fixing device in the embodiment of the present invention.

FIG. 12 is a partial cross sectional view taken along a plane passing through the axes of the fixing roller 51 and rotation shaft 537 of the fixing device 50, showing a state of the fixing device 50 after the rotation shaft 537 is rotated clockwise by approximately 45° from the third stage.

Figure 13A:
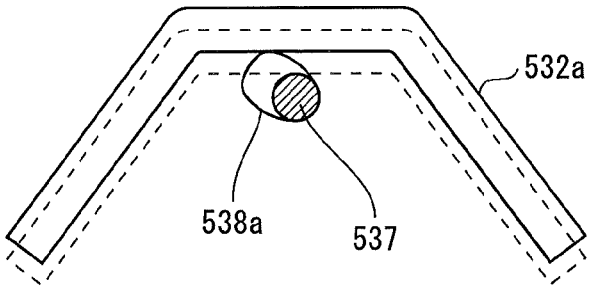
FIGS. 13A through 13D are cross sectional views illustrating the positional relationships between the cams and corresponding arch cores in the fourth stage when the device is viewed from the axis direction.
Figure 13B:
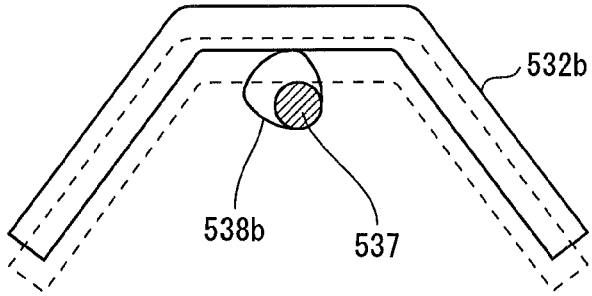
Figure 13C:
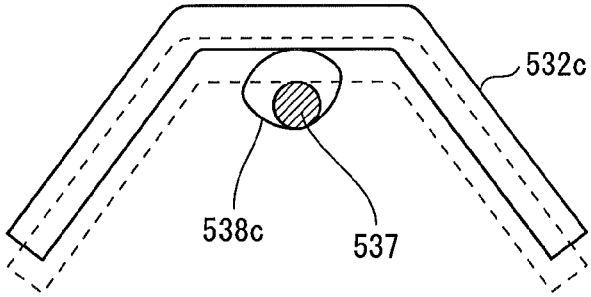
Figure 13D:
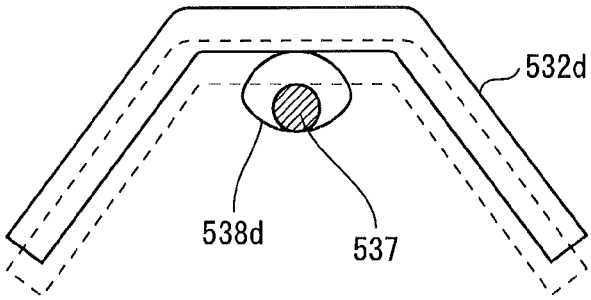

FIGS. 13A through 13D are cross sectional views illustrating the positional relationships between the cams 538 and the arch cores 532 when the device in the state illustrated in FIG. 12 (hereinafter, the arrangement of the arch cores 532 in this state is referred to as "fourth stage") is viewed from the axis direction. FIG. 13A illustrates the positional relationships between the cam 538*a* and the arch core 532*a*. FIG. 13B illustrates the positional relationships between the cam 538*b* and the arch core 532*b*. FIG. 13C illustrates the positional relationships between the cam 538*c* and the arch core 532*c*. FIG. 13D illustrates the positional relationships between the cam 538*d* and the arch core 532*d*.

As shown in FIG. 12 and FIGS. 13A through 13D, in the fourth stage, the cam surfaces of the cams 538*d*, 538*c* and 538*b*, which are, among the cams 538, located first, second and third closest to both ends of the fixing roller 51 in its width direction, are in contact with the arch cores 532*d*, 532*c* and 532*b*. This displaces the arch cores 532*d*, 532*c* and 532*b* to the distant position. At this time, a circumferential surface of a side of the fan shape of each cam 538*a* is in contact with an arch core 532*a*, displacing the arch core 532*a* to a position in the middle of the closest position and the distant position.

Figure 14:
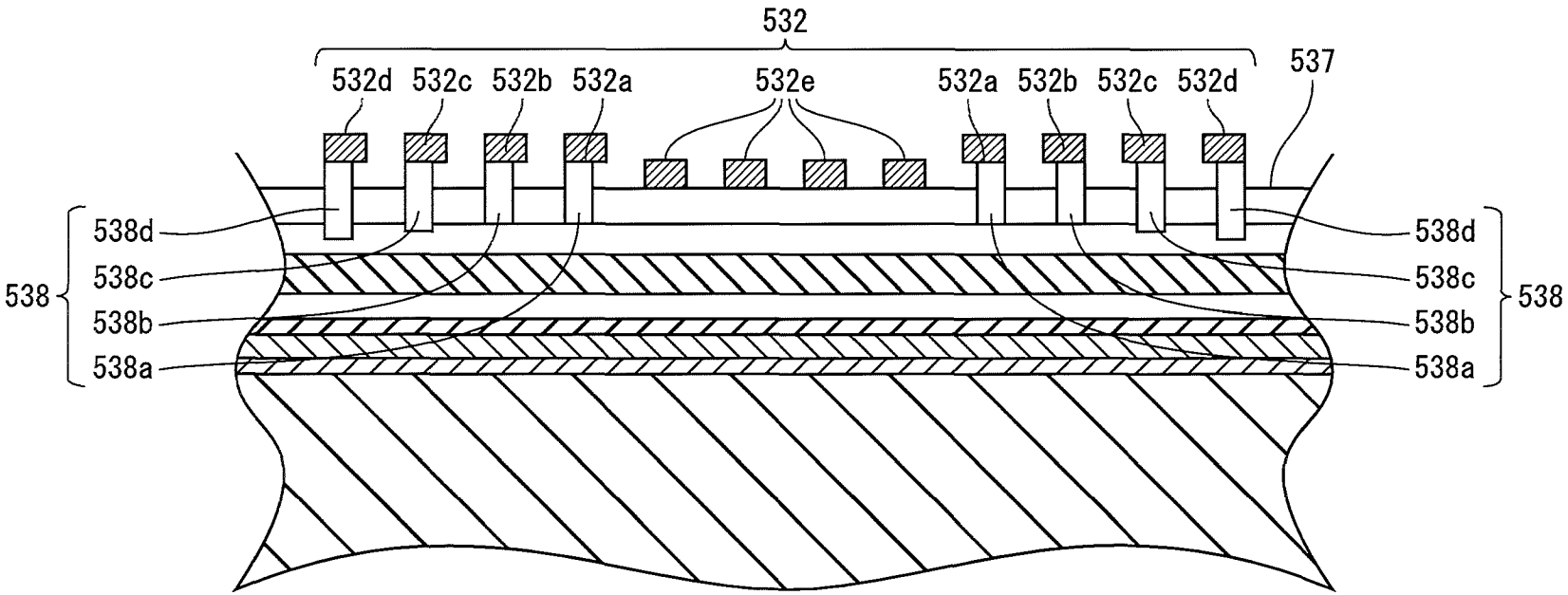
FIG. 14 is a partial cross sectional view illustrating the positional relationships between arch cores in the fifth stage in the fixing device in the embodiment of the present invention.

FIG. 14 is a partial cross sectional view taken along a plane passing through the axes of the fixing roller 51 and rotation shaft 537 of the fixing device 50, showing a state of the fixing device 50 after the rotation shaft 537 is rotated clockwise by approximately 45° from the fourth stage.

Figure 15A:
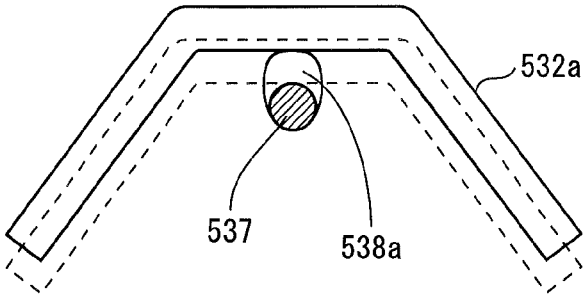
FIGS. 15A through 15D are cross sectional views illustrating the positional relationships between the cams and corresponding arch cores in the fifth stage when the device is viewed from the axis direction.
Figure 15B:
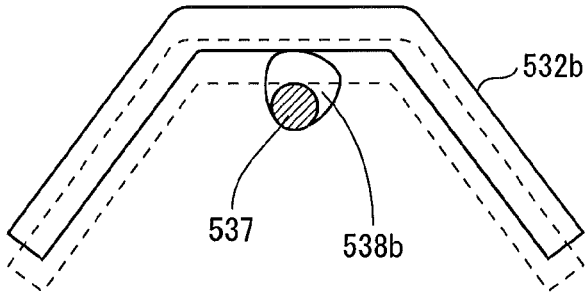
Figure 15C:
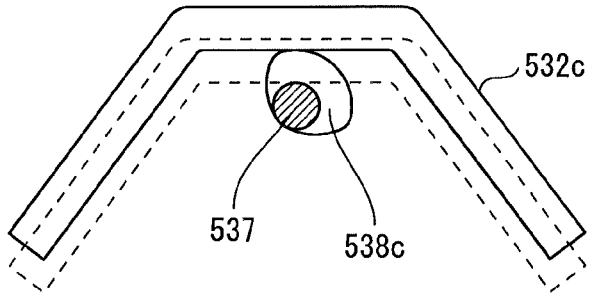
Figure 15D:
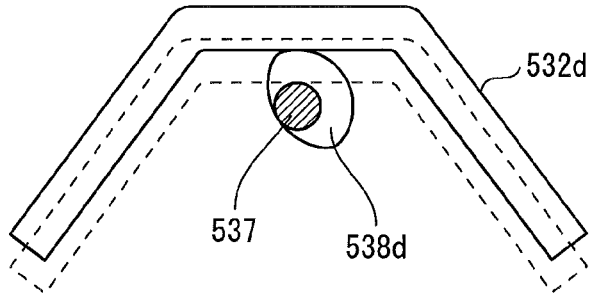

FIGS. 15A through 15D are cross sectional views illustrating the positional relationships between the cams 538 and the arch cores 532 when the device in the state illustrated in FIG. 14 (hereinafter, the arrangement of the arch cores 532 in this state is referred to as "fifth stage") is viewed from the axis direction. FIG. 15A illustrates the positional relationships between the cam 538*a* and the arch core 532*a*. FIG. 15B illustrates the positional relationships between the cam 538*b* and the arch core 532*b*. FIG. 15C illustrates the positional relationships between the cam 538*c* and the arch core 532*c*. FIG. 15D illustrates the positional relationships between the cam 538*d* and the arch core 532*d*.

As shown in FIG. 14 and FIGS. 15A through 15D, in the fifth stage, the cam surfaces of all the cams 538*d*, 538*c*, 538*b* and 538*a* are in contact with the arch cores 532*d*, 532*c*, 532*b* and 532*a*. This displaces the arch cores 532*d*, 532*c*, 532*b* and 532*a* to the distant position.

The state of the fixing device 50 returns to the first stage if the rotation shaft 537 is rotated clockwise by approximately 135° from the fifth stage. Also, the state of the fixing device 50 returns by one stage if the rotation shaft 537 is rotated counterclockwise by approximately 45° from each stage.

It is possible to control the amount of heat generated in the electromagnetic induction heating layer 514 of the non-paper-pass-through parts, by instructing the motor rotation control unit 45 to rotate the motor 81 to cause the rotation shaft 537 to rotate, and changing the arrangement stage of the arch cores 532 with the change of the rotation angle of the rotation shaft 537.

(1-5. Fixing Temperature Control)

The following describes how fixing temperature of the fixing roller 51 is controlled while the image forming operation is performed.

<Fixing Temperature Main Control>

Figure 16:
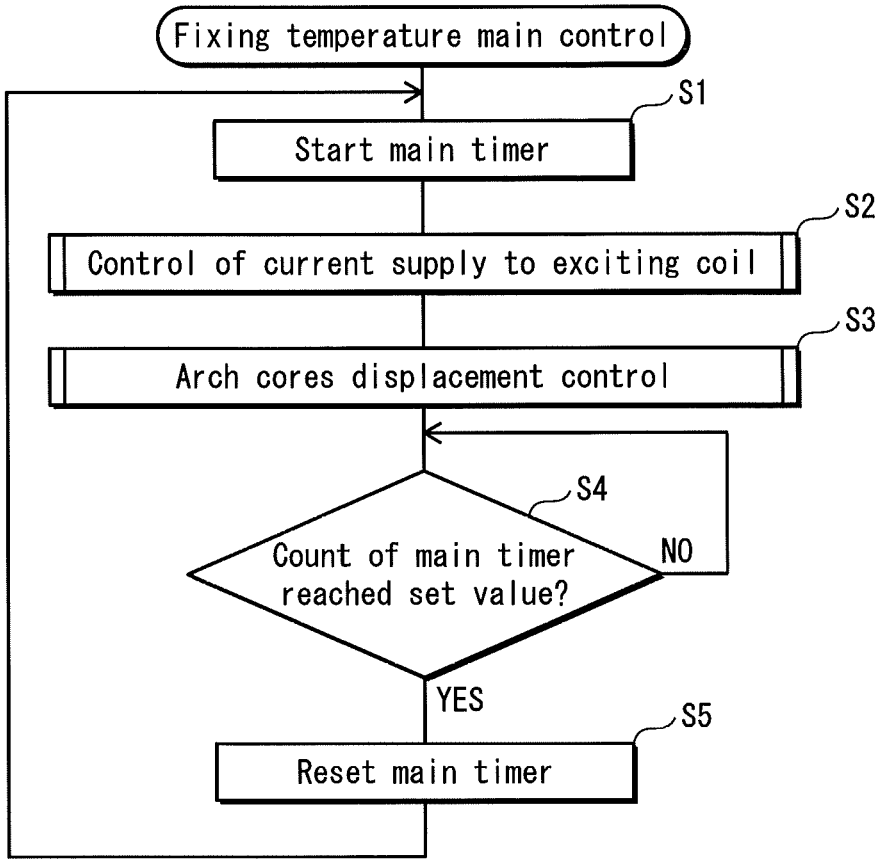
FIG. 16 is a flowchart showing the procedure of a fixing temperature main control in the embodiment of the present invention.

FIG. 16 is a flowchart showing the procedure of the fixing temperature main control. The controller 40 maintains the temperature in the paper-pass-through part on the surface of the fixing roller 51 to the fixing temperature by controlling the current supply to the exciting coil 531 and the displacement of the arch cores 532.

If the printer 100 is powered ON, the main timer is started (step S1). The main timer defines the time required for a routine to complete one cycle of process. The main timer is set to count, for example, 200 [msec] per cycle.

Next, the process for control of current supply to the exciting coil is executed (step S2). More specifically, the process shown in the flowchart of FIG. 17 to be described later is executed.

After the process for control of current supply to the exciting coil is executed, the process for arch cores displacement control is executed (step S3). More specifically, the process shown in the flowchart of FIG. 18 to be described later is executed.

After the process for arch cores displacement control, it is judged whether or not the count of the main timer has reached a set value (for example, 200 [msec]) (step S4).

If it is judged that the count of the main timer has not reached the set value, the judgment is repeated (step S4: NO, step S4).

If it is judged that the count of the main timer has reached the set value, the main timer is reset, the control returns to step S1, and the main timer is started again (step S4: YES, step S5, step S1). Following this, the flow is repeated.

<Control of Current Supply to Exciting Coil>

Figure 17:
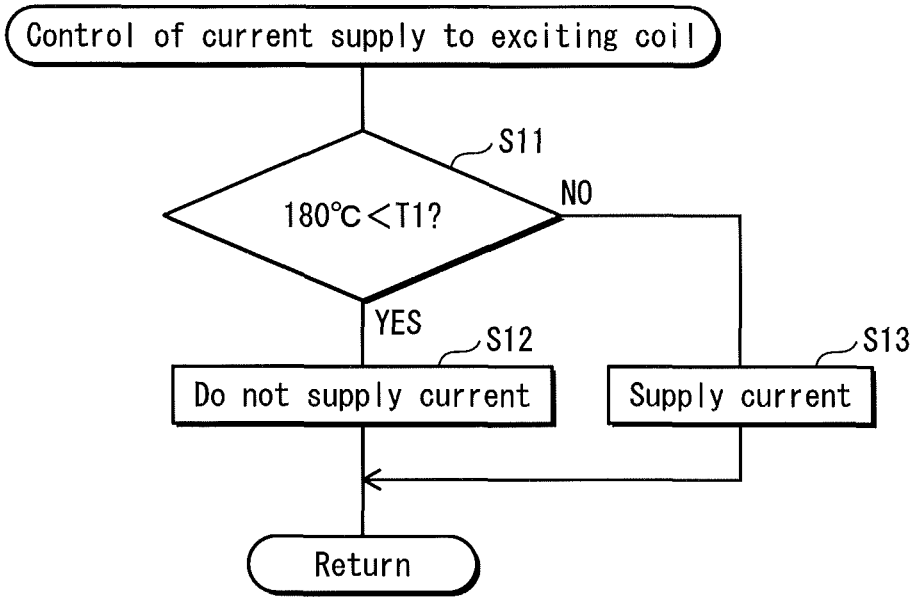
FIG. 17 is a flowchart showing the procedure of control of current supply to an exciting coil in the embodiment of the present invention.

FIG. 17 is a flowchart showing the procedure of control of current supply to the exciting coil, which is a subroutine of the fixing temperature main control shown in FIG. 16.

After the subroutine for control of current supply to the exciting coil is called in the flow of the fixing temperature main control, a detected temperature T1, which is a surface temperature of the fixing roller 51 detected by the center temperature sensor 71, is obtained and judged whether or not T1 is higher than 180° C. (step S11).

If it is judged that T1 is higher than 180° C., the current supply to the exciting coil 531 is not performed (step S11: YES, step S12), and the control returns to the flow of the fixing temperature main control.

If it is judged that T1 is not higher than 180° C., namely, T1 is equal to or lower than 180° C., the current supply to the exciting coil 531 is performed (step S11: NO, step S13), and the control returns to the flow of the fixing temperature main control.

<Arch Cores Displacement Control>

Figure 18:
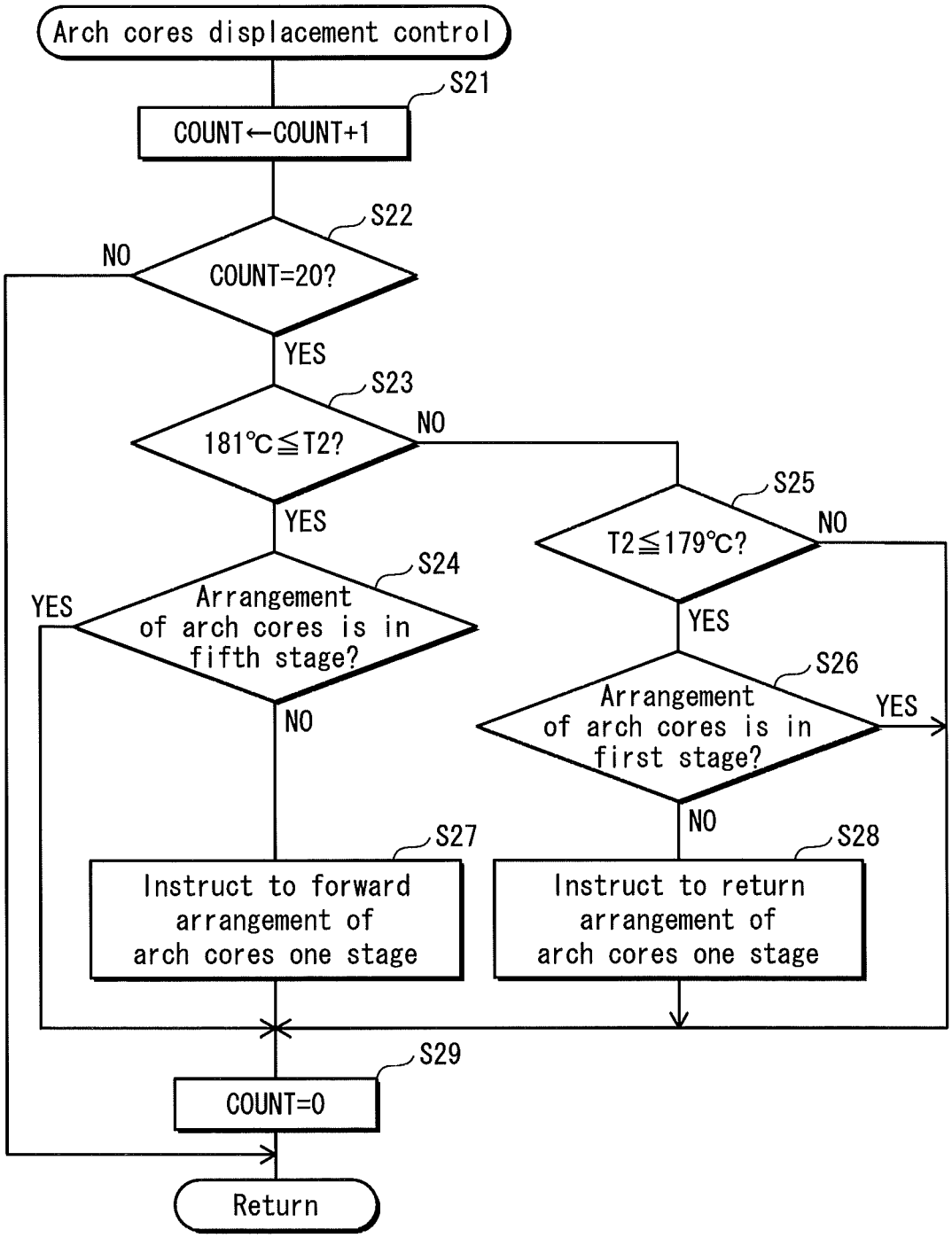
FIG. 18 is a flowchart showing the procedure of arch cores displacement control in Embodiment 1 of the present invention.

FIG. 18 is a flowchart showing the procedure of arch cores displacement control, which is a subroutine of the fixing temperature main control shown in FIG. 16.

If the subroutine for arch cores displacement control is called in the flow of the fixing temperature main control, the present value of "COUNT", which indicates the number of times the control has entered this flow, is incremented by "1", and then it is judged whether or not the value COUNT is 20 (step S21, step S22).

If it is judged that the value COUNT is not 20 (step S22: NO), the control returns to the flow of the fixing temperature main control.

If it is judged that the value COUNT is 20, a detected temperature T2, which is a surface temperature of the fixing roller 51 detected by the end temperature sensor 72, is obtained and judged whether or not T2 is equal to or higher than 181° C. (first threshold value) (step S22: YES, step S23).

If it is judged that T2 is equal to or higher than 181° C., it is judged whether or not the arrangement of the arch cores 532 is in the fifth stage (step 23: YES, step S24).

If it is judged that the arrangement of the arch cores 532 is in the fifth stage, the value COUNT is reset to 0 (step 24: YES, step S29), and the control returns to the flow of the fixing temperature main control.

If it is judged that the arrangement of the arch cores 532 is not in the fifth stage, the motor rotation control unit 45 is instructed to forward the arrangement of the arch cores 532 one stage, the value COUNT is reset to 0 (step 24: NO, step S27, step S29), and the control returns to the flow of the fixing temperature main control.

If it is judged in step 23 that T2 is neither equal to nor higher than 181° C., namely, T2 is lower than 181° C., it is judged whether or not T2 is equal to or lower than 179° C. (second threshold value) (step S23: NO, step S25).

If it is judged that T2 is neither equal to nor lower than 179° C., namely, T2 is higher than 179° C., the value COUNT is reset to 0 (step 25: NO, step S29), and the control returns to the flow of the fixing temperature main control.

If it is judged that T2 is equal to or lower than 179° C., it is judged whether or not the arrangement of the arch cores 532 is in the first stage (step 25: YES, step S26).

If it is judged that the arrangement of the arch cores 532 is in the first stage, the value COUNT is reset to 0 (step 26: YES, step S29), and the control returns to the flow of the fixing temperature main control.

If it is judged that the arrangement of the arch cores 532 is not in the first stage, the motor rotation control unit 45 is instructed to return the arrangement of the arch cores 532 one stage, the value COUNT is reset to 0 (step 26: NO, step S28, step S29), and the control returns to the flow of the fixing temperature main control.

As described above, in the present embodiment, with the control of the current supply to the exciting coil, the surface temperature of the fixing roller 51 at the center is maintained to 180° C. Also, the end temperature sensor 72 detects the surface temperature of the fixing roller 51 in the vicinity of an end thereof at regular time intervals (in the present embodiment, for example, once every four seconds), and each time the surface temperature of the fixing roller 51 in a non-paper-pass-through part is lower than 179° C., the arrangement of the arch cores 532 is returned one stage, namely, the arch cores 532 are moved closer to the electromagnetic induction heating layer 514 in sequence from the ones at the center to the ones at both ends of the fixing roller 51 in the width direction thereof, increasing the amount of heat generated in the electromagnetic induction heating layer 514 of the non-paper-pass-through parts. Furthermore, each time the surface temperature of the fixing roller 51 in a non-paper-pass-through part is higher than 181° C., the arrangement of the arch cores 532 is forwarded one stage, namely, the arch cores 532 are moved away from the electromagnetic induction heating layer 514 in sequence from the ones at both ends to the ones at the center of the fixing roller 51 in the width direction thereof, restricting the amount of heat generated in the electromagnetic induction heating layer 514 of the non-paper-pass-through parts. With this structure, the surface temperature of the fixing roller 51 in the non-paper-pass-through parts is maintained between 179° C. and 181° C., and the fixing roller is prevented from being overheated.

Also, since the arch cores displacement control is performed one stage by one stage depending on the temperature T2, it is possible to carefully control the amount of heat generated in the electromagnetic induction heating layer 514, based on the level of overheating of the non-paper-pass-through parts.

Note that, since the flow of the fixing temperature main control is set to 200 [msec] per cycle as one example, the control of the current supply to the exciting coil is executed every 200 [msec] as well.

On the other hand, in the arch cores displacement control, as shown in the flowchart of FIG. 18, the value COUNT is incremented every 200 [msec], and if the value COUNT has reached "20", the control moves from step S23 to step S28, then the value COUNT is reset to 0, and the control returns to the flow of the fixing temperature main control. With this structure, the process of actually displacing the arch cores in steps S23 through S28 is executed every four seconds.

Also note that the value, which is compared with the value COUNT for the judgment of match between them in step S22 in the flow of the arch cores displacement control, is not limited to "20" but may be any other appropriate value.

Embodiment 2

In Embodiment 1, a description was given of a structure for controlling the amount of heat generated in the electromagnetic induction heating layer, based on the surface temperatures of the fixing roller 51 detected by the temperature sensors at the center of the paper-pass-through part, and a non-paper-pass-through part.

Each time a recording sheet passes through, the paper-pass-through part of the fixing roller loses heat, but the non-paper-pass-through parts do not because they do not contact with the recording sheet. This would lead to an overheat of the non-paper-pass-through parts. For example, when a recording sheet of small size such as A5 vertical passes through continuously, the non-paper-pass-through parts are wide and thus highly overheated; but when a recording sheet of large size such as A3 is used, the non-paper-pass-through parts for a small-size sheet partially turn into the paper-pass-through part to lose heat and thus are difficult to be overheated.

In the present embodiment, instead of the surface temperature of the fixing roller 51 detected at a non-paper-pass-through part, the size (paper-pass width) of the recording sheet on which an image is to be formed is obtained, and the arch cores displacement control is performed in accordance with the paper-pass width to prevent the non-paper-pass-through parts from being overheated. As one example of the present embodiment, the A4 vertical size, which is considered to be used most frequently in the office or the like, is set as the standard, it is judged whether a paper-pass width is larger than, smaller than, or equal to the A4 vertical size, and the stage of the arrangement of the arch cores 532 is changed depending on the result of the judgment.

Also, in the present embodiment, an arch core timer is used and the arrangement of the arch cores 532 is returned to the first stage if no image print signal is input for a predetermined time period.

In the following, to avoid overlapping explanation, the structural elements that are the same as those in Embodiment 1 are assigned the same reference signs, and description thereof is omitted.

Figure 19:
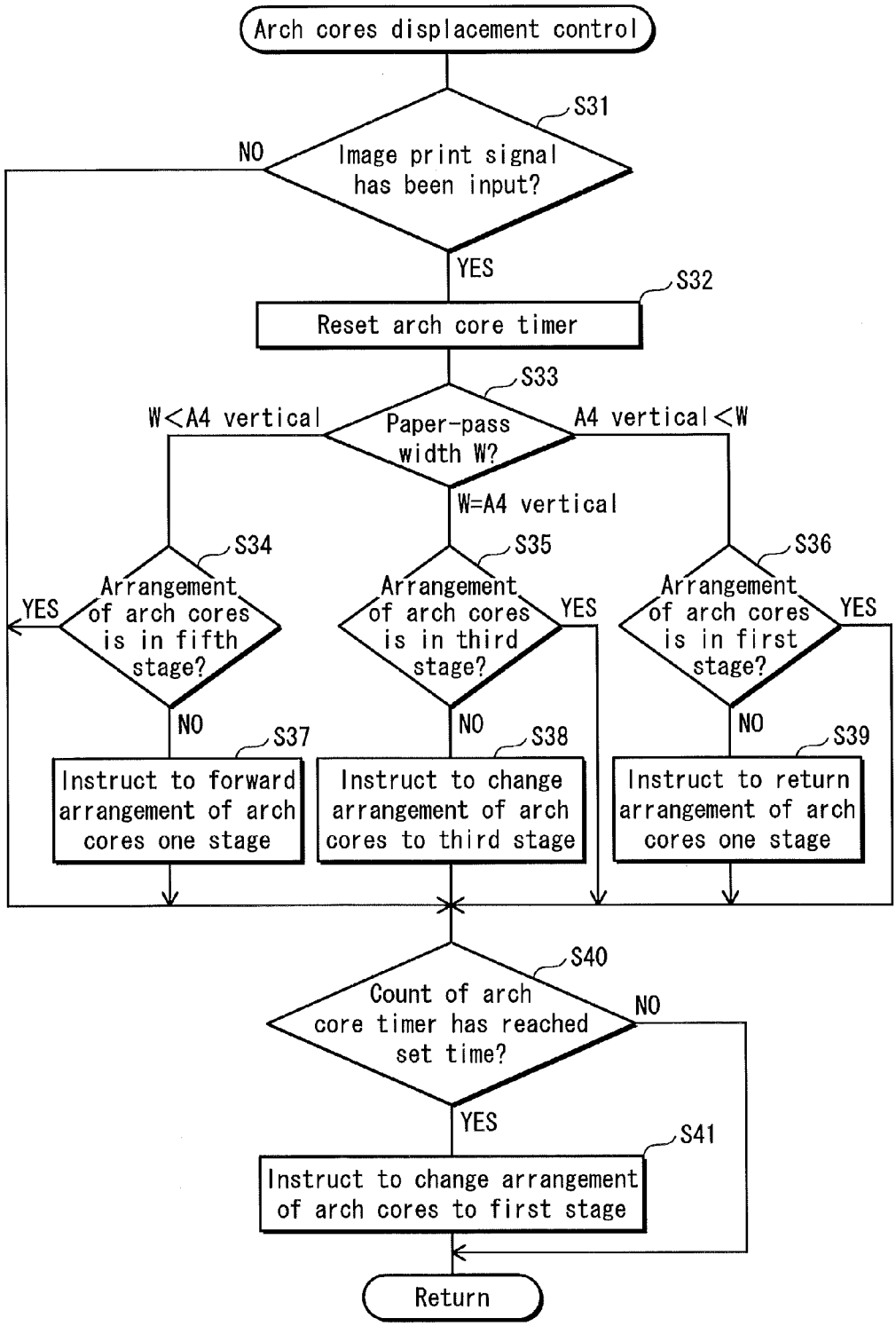
FIG. 19 is a flowchart showing the procedure of arch cores displacement control in Embodiment 2 of the present invention.

FIG. 19 is a flowchart showing the procedure of a subroutine for arch cores displacement control in the present embodiment. This subroutine is executed each time the subroutine is called in the flow of the fixing temperature main control shown in FIG. 16.

First, it is judged whether or not an image print signal (for one sheet of paper) has been input (step S31).

If it is judged that no image print signal has been input, it is judged whether or not the count of the arch core timer has reached a set time (whether or not a set predetermined time period has expired) (step S31: NO, step S40).

If it is judged that an image print signal has been input, the arch core timer is reset (step S31: YES, step S32).

Next, a judgment on a paper-pass width W is made (step S33). If the paper-pass width W is smaller than A4 vertical, it is judged whether or not the arrangement of the arch cores 532 is in the fifth stage (step S33: W<A4 vertical, step S34). It should be noted here that information of the paper-pass width is obtained and the judgment on the paper-pass width is made as the paper-pass width determining unit 46 (the first sheet size obtaining unit) (see FIG. 2) reads the header information of the print job data received by the communication I/F 42, or receives information of a selected recording sheet (paper feed tray) input by the user on the operation panel 2. In the following, the obtainment of the paper-pass width and the judgment are performed in the same manner as described above except when otherwise noted.

If it is judged that the arrangement of the arch cores 532 is not in the fifth stage, the motor rotation control unit 45 is instructed to forward the arrangement of the arch cores 532 one stage, and it is judged whether or not the count of the arch core timer has reached the set time (step S34: NO, step S37, step S40).

If it is judged that the arrangement of the arch cores 532 is in the fifth stage, the stage of the arrangement of the arch cores 532 cannot be forwarded any further since the fifth stage is the highest stage, thus it is judged whether or not the count of the arch core timer has reached the set time (step S34: YES, step S40).

If it is judged in step S33 that the paper-pass width W is equal to A4 vertical, it is judged whether or not the arrangement of the arch cores 532 is in the third stage (step S33: W=A4 vertical, step S35).

If it is judged that the arrangement of the arch cores 532 is not in the third stage, the motor rotation control unit 45 is instructed to change the arrangement of the arch cores 532 to the third stage which is the basic arrangement of the arch cores 532 when a recording sheet of A4 vertical size passes through (fourth control), and it is judged whether or not the count of the arch core timer has reached the set time (step S35: NO, step S38, step S40).

If it is judged that the arrangement of the arch cores 532 is in the third stage, it is judged whether or not the count of the arch core timer has reached the set time (step S35: YES, step S40).

If it is judged in step S33 that the paper-pass width W is larger than A4 vertical, it is judged whether or not the arrangement of the arch cores 532 is in the first stage (step S33: A4 vertical<W, step S36).

If it is judged that the arrangement of the arch cores 532 is not in the first stage, the motor rotation control unit 45 is instructed to return the arrangement of the arch cores 532 one stage, and it is judged whether or not the count of the arch core timer has reached the set time (step S36: NO, step S39, step S40).

If it is judged that the arrangement of the arch cores 532 is in the first stage, the stage of the arrangement of the arch cores 532 is not changed since it cannot be returned any further, and it is judged whether or not the count of the arch core timer has reached the set time (step S36: YES, step S40).

If it is judged that the count of the arch core timer has reached the set time, the motor rotation control unit 45 is instructed to change the arrangement of the arch cores 532 to the first stage (step S40: YES, step S41), and the control returns to the flow of the fixing temperature main control (see FIG. 16).

If it is judged that the count of the arch core timer has not reached the set time (step S40: NO), the control returns to the flow of the fixing temperature main control.

As described above, according to the structure of the present embodiment, the size (paper-pass width) of the recording sheet to be passed through is obtained, and based on the paper-pass width, the arch cores displacement control is performed as follows: if the paper-pass width W is equal to A4 vertical, the arrangement of the arch cores 532 is changed to the third stage (if it is already in the third stage, the third stage is maintained); if the paper-pass width W is smaller than A4 vertical, which means that the area (width) that loses heat to the recording sheet is small and the non-paper-pass-through parts are apt to be overheated, the arrangement of the arch cores 532 is forwarded one stage by one stage so that the arch cores 532 are moved away from the electromagnetic induction heating layer 514 in sequence from the ones at both ends to the ones at the center of the fixing roller 51 in the width direction thereof, restricting the amount of heat generated in the electromagnetic induction heating layer 514 of the non-paper-pass-through parts; and if the paper-pass width W is larger than A4 vertical, which means that the area (width) of the paper-pass-through part is large and the area (width) of the non-paper-pass-through parts whose heat needs to be restricted is small, the arrangement of the arch cores 532 is returned one stage by one stage, namely, the arch cores 532 are moved closer to the electromagnetic induction heating layer in sequence from the ones at the center to the ones at both ends of the fixing roller 51 in the width direction thereof, increasing the amount of heat generated in the electromagnetic induction heating layer of the areas outside (the areas on the both sides of) the width of A4 vertical in the paper-pass-through part to secure a sufficient fixing temperature in the paper-pass-through part.

Embodiment 3

If, for example, a recording sheet of A4 vertical, and then a large-size recording sheet (for example, A3) is passed through, thanks to the residual heat of the fixing roller, the surface temperature of the fixing roller can be maintained in a temperature range at which images can be fixed onto a certain number of recording sheets, without immediate returning of the stage of the arrangement of the arch cores 532. However, if large-size recording sheets in excess of the certain number are passed through, the amount of heat becomes insufficient.

In view of this, in the present embodiment, if a recording sheet of a size, namely, a paper-pass width larger than A4 vertical (a predetermined size in the width direction of a predetermined sheet) is to be passed through, the stage of the arrangement of the arch cores 532 is not changed until a predetermined number (first predetermined number, for example, in the present embodiment, "four (4)") of the sheets are passed through continuously; and the arrangement of the arch cores 532 is changed to the first stage all at once if the certain number of the sheets are passed through continuously (third control).

In the following, to avoid overlapping explanation, the same reference signs are assigned to the structural elements that are the same all through the embodiments, and description thereof is omitted.

Figure 20:
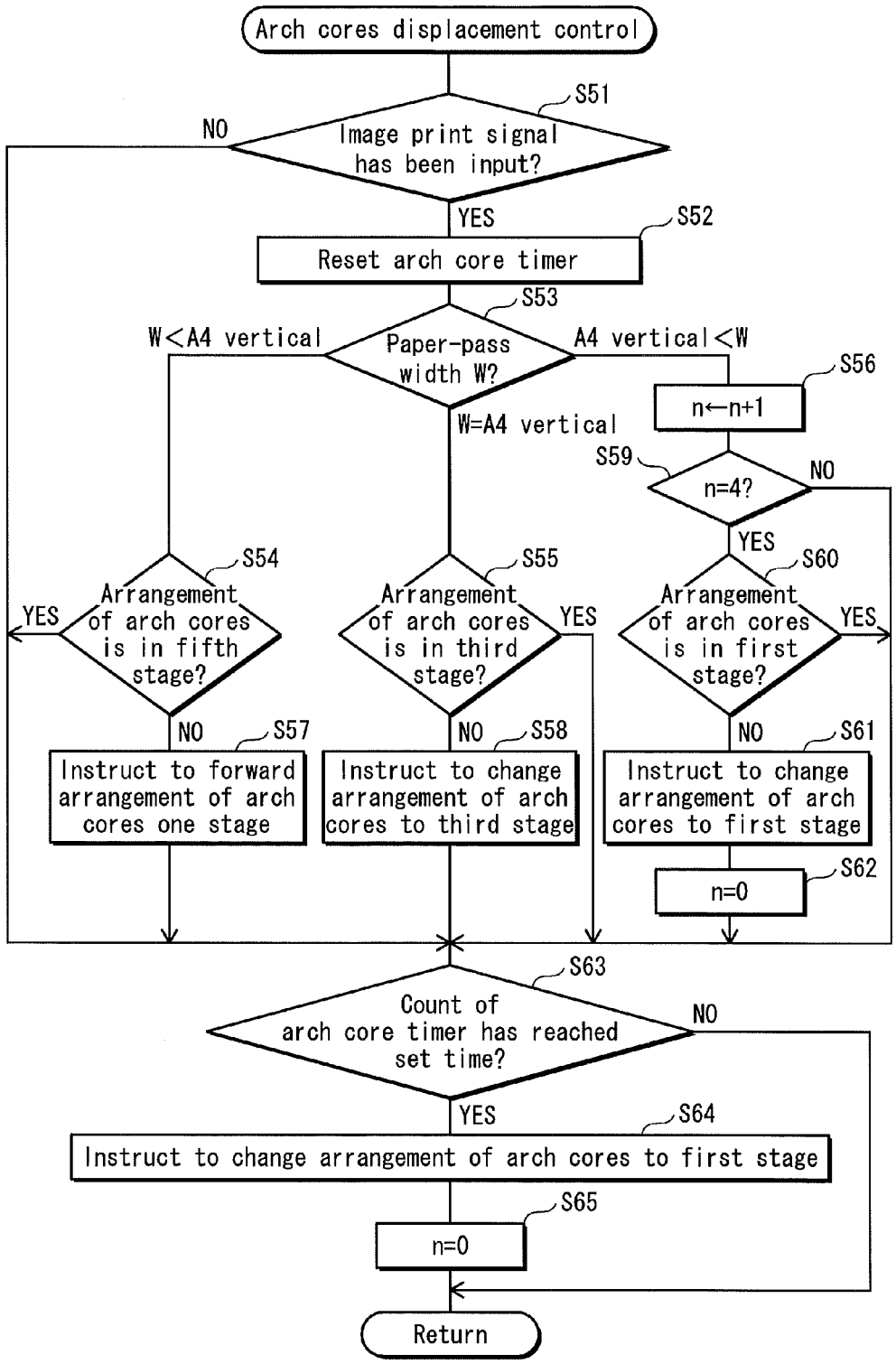
FIG. 20 is a flowchart showing the procedure of arch cores displacement control in Embodiment 3 of the present invention.

FIG. 20 is a flowchart showing the procedure of a subroutine for arch cores displacement control in the present embodiment. This subroutine is executed each time the subroutine is called in the flow of the fixing temperature main control shown in FIG. 16.

Note that steps S51 through S53, steps S53 through S57 which are performed if it is judged in step S53 that the paper-pass width W is smaller than A4 vertical, and steps S53 through S58 which are performed if it is judged in step S53 that the paper-pass width W is equal to A4 vertical, in the flow of the present subroutine, are the same as steps S31 through S33, steps S33 through S37 which are performed if it is judged in step S33 that the paper-pass width W is smaller than A4 vertical, and steps S33 through S38 which are performed if it is judged in step S33 that the paper-pass width W is equal to A4 vertical, in the flow of arch cores displacement control in Embodiment 2 shown in FIG. 19, respectively, and description thereof is omitted here.

If it is judged in step S53 that the paper-pass width W is larger than A4 vertical, a value "n", which indicates the number of large-size recording sheets that were continuously passed through, is incremented by "1", and it is judged whether or not the value "n" is "4" (step S53: A4 vertical<W, step S56, step S59).

If it is judged that the value "n" is not "4", it is judged whether or not the count of the arch core timer has reached the set time (step S59: NO, step S63).

If it is judged that the value "n" is "4", it is judged whether or not the arrangement of the arch cores 532 is in the first stage (step S59: YES, step S60).

If it is judged that the arrangement of the arch cores 532 is not in the first stage, the motor rotation control unit 45 is instructed to return the arrangement of the arch cores 532 to the first stage, the value "n" is reset to "0", and it is judged whether or not the count of the arch core timer has reached the set time (step S60: NO, step S61, step S62, step S63).

If it is judged that the arrangement of the arch cores 532 is in the first stage, it is judged whether or not the count of the arch core timer has reached the set time (step S60: YES, step S63).

If it is judged that the count of the arch core timer has reached the set time, the motor rotation control unit 45 is instructed to change the arrangement of the arch cores 532 to the first stage, the value "n" is reset to "0" (step S63: YES, step S64, step S65), and the control returns to the flow of the fixing temperature main control (see FIG. 16).

If it is judged in step S63 that the count of the arch core timer has not reached the set time, (step S63: NO), the control returns to the flow of the fixing temperature main control.

Embodiment 4

In Embodiments 2 and 3, the stage of the arrangement of the arch cores 532 is changed in accordance with an actual fixing state. However, the present invention is not limited to this. In the present embodiment, the size of a recording sheet, which is to be passed through after a predetermined number (second predetermined number, for example, in the present embodiment, "five (5)")) of recording sheets are passed through, is obtained, and the stage of the arrangement of the arch cores 532 is preliminarily changed in accordance with the obtained size.

In the following, to avoid overlapping explanation, the same reference signs are assigned to the structural elements that are the same all through the embodiments, and description thereof is omitted.

Figure 21:
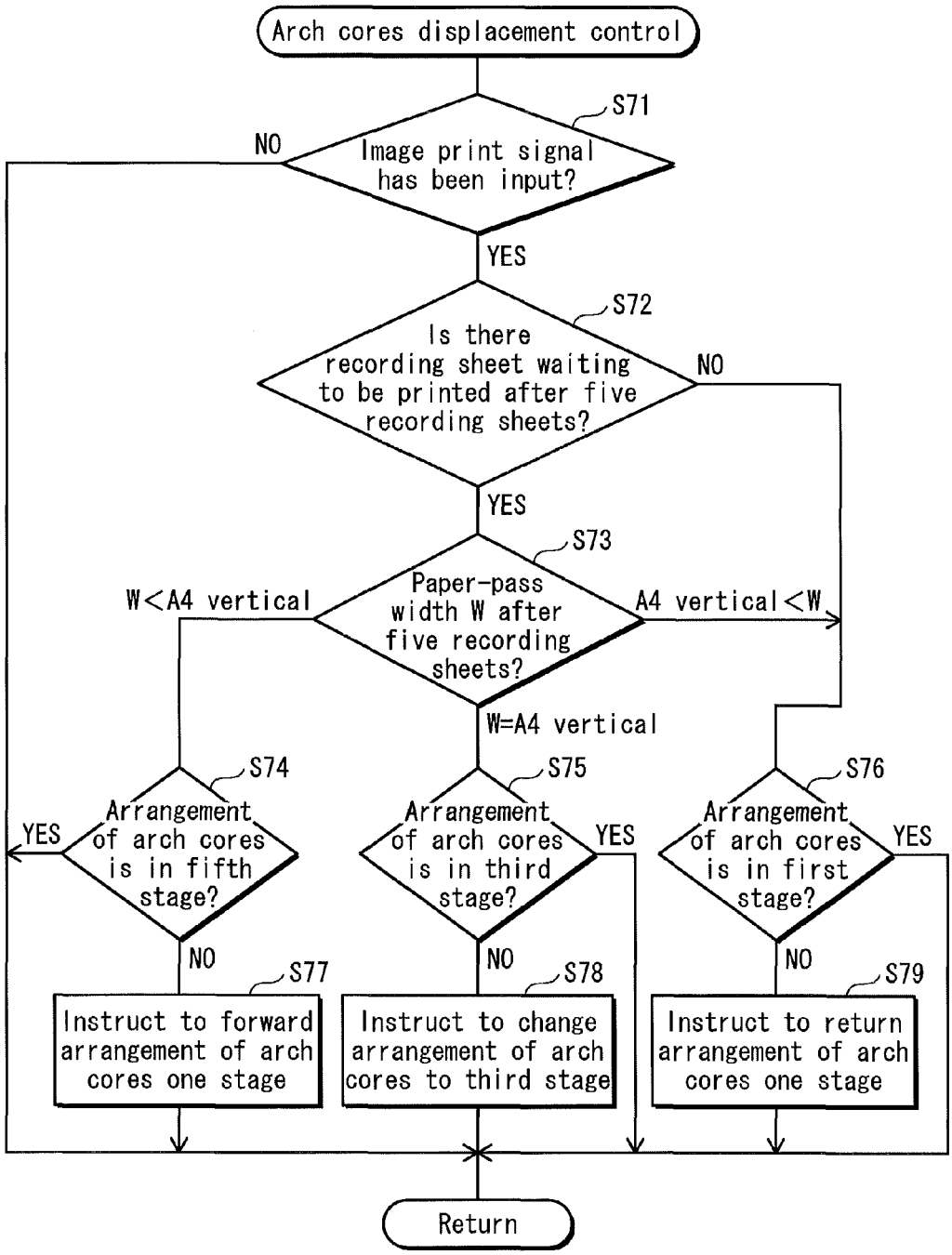
FIG. 21 is a flowchart showing the procedure of arch cores displacement control in Embodiment 4 of the present invention.

FIG. 21 is a flowchart showing the procedure of a subroutine for arch cores displacement control in the present embodiment. This subroutine is executed each time the subroutine is called in the flow of the fixing temperature main control shown in FIG. 16.

First, it is judged whether or not an image print signal (for one sheet of paper) has been input (step S71).

If it is judged that no image print signal has been input (step S71: NO), the control returns to the flow of the fixing temperature main control (see FIG. 16).

If it is judged that an image print signal has been input (step S71: YES), it is judged whether or not there is an image print signal for a recording sheet waiting to be printed after five recording sheets (step S71: YES, step S72). It should be noted here that the judgment on whether or not there is an image print signal for a recording sheet waiting to be printed after five recording sheets and the judgment on the paper-pass width of the recording sheet for which the image print signal is to be executed, which will be described below, are made as the paper-pass width determining unit 46 (the second sheet size obtaining unit) (see FIG. 2) refers to the data of the print-wait image print signal temporarily stored in the RAM 44 (see FIG. 2).

If it is judged that there is an image print signal for a recording sheet waiting to be printed after five recording sheets, a judgment on a paper-pass width W of the recording sheet for which the image print signal is to be executed is made (step S72: YES, step S73).

If the paper-pass width W is smaller than A4 vertical, it is judged whether or not the arrangement of the arch cores 532 is in the fifth stage (step S73: W<A4 vertical, step S74).

If it is judged that the arrangement of the arch cores 532 is not in the fifth stage, the motor rotation control unit 45 is instructed to forward the arrangement of the arch cores 532 one stage (step S74: NO, step S77), and the control returns to the flow of the fixing temperature main control (see FIG. 16).

If it is judged that the arrangement of the arch cores 532 is in the fifth stage, the stage of the arrangement of the arch cores 532 cannot be forwarded any further since the fifth stage is the highest stage, thus the control returns to the flow of the fixing temperature main control.

If it is judged in step S73 that the paper-pass width W is equal to A4 vertical, it is judged whether or not the arrangement of the arch cores 532 is in the third stage (step S73: W=A4 vertical, step S75).

If it is judged that the arrangement of the arch cores 532 is not in the third stage, the motor rotation control unit 45 is instructed to change the arrangement of the arch cores 532 to the third stage which is the basic arrangement of the arch cores 532 when a recording sheet of A4 vertical size passes through (step S75: NO, step S78), and the control returns to the flow of the fixing temperature main control.

If it is judged that the arrangement of the arch cores 532 is in the third stage, the control returns to the flow of the fixing temperature main control.

If it is judged in step S73 that the paper-pass width W is larger than A4 vertical, it is judged whether or not the arrangement of the arch cores 532 is in the first stage (step S73: A4 vertical<W, step S76).

If it is judged that the arrangement of the arch cores 532 is not in the first stage, the motor rotation control unit 45 is instructed to return the arrangement of the arch cores 532 one stage (step S76: NO, step S79), and the control returns to the flow of the fixing temperature main control.

If it is judged that the arrangement of the arch cores 532 is in the first stage (step S76: YES), the control returns to the flow of the fixing temperature main control since the stage of the arrangement of the arch cores 532 cannot be returned any further.

As described in each embodiment above, the present invention appropriately prevents the non-paper-pass-through parts from being overheated and appropriately maintains the fixing temperature in the paper-pass-through part, by carefully controlling the amount of heat in the axis direction (width direction) of the heat rotation body, by displacing the arch cores 532 in sequence with the rotation of the cams 538 attached on the circumferential surface of the rotation shaft 537 to control the amount of heat generated in the electromagnetic induction heating layer.

Also, since the rotation shaft 537 is a magnetic body and is arranged along a straight line that connects each center of the arch cores 532, the rotation shaft 537 can fulfill a role of a center core as a flux path forming body that forms a flux path between the arch cores 532 and the fixing roller 51.

Furthermore, since the cams 538 are nonmagnetic bodies, the following effect is produced. That is to say, with the structure where the cams 538 are present between the arch cores 532 and the rotation shaft 537 when the arch cores 532 are positioned away from the electromagnetic induction heating layer 514, the magnetic bind between the arch cores 532 and the fixing roller 51 is restricted.

<Modifications>

(1) In Embodiments 2, 3 and 4 above, if the paper-pass width is A4 vertical and the arrangement of the arch cores 532 is not in the third stage, the motor rotation control unit 45 is instructed to change the arrangement of the arch cores 532 directly to the third stage. However, not limited to this, for example, if it is judged that the arrangement of the arch cores 532 is not in the third stage, the arrangement of the arch cores 532 may be forwarded or returned one stage by one stage.

The following describes the arch cores displacement control in the present modification, taking, as an example, the case where the structure of the present modification is applied to Embodiment 2.

In the following, to avoid overlapping explanation, the same reference signs are assigned to the structural elements that are the same through the embodiments and the modification, and description thereof is omitted.

Figure 22:
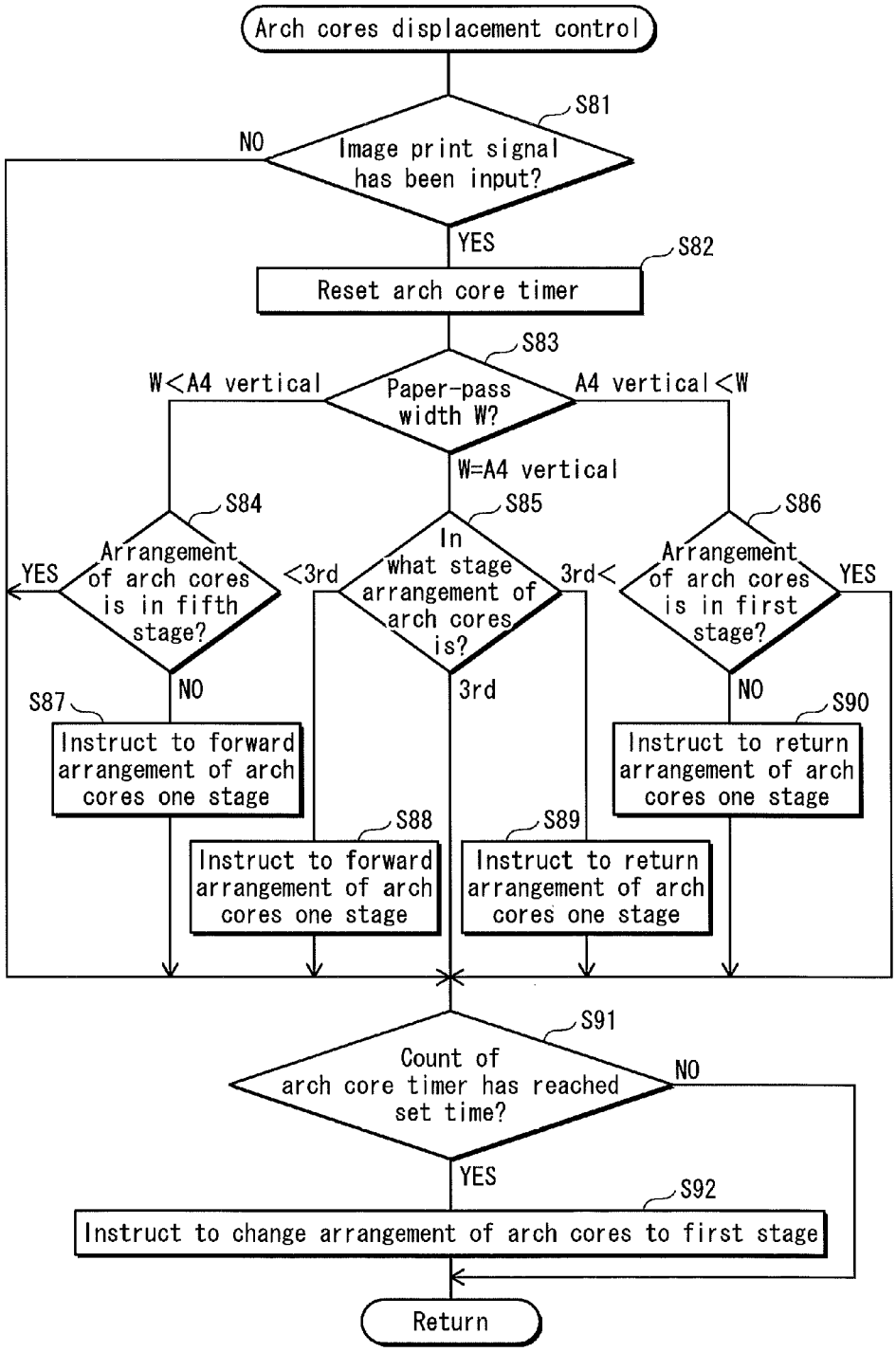
FIG. 22 is a flowchart showing the procedure of arch cores displacement control in Modification 1 of the present invention.

FIG. 22 is a flowchart showing the procedure of a subroutine for arch cores displacement control in the present modification. This subroutine is executed each time the subroutine is called in the flow of the fixing temperature main control shown in FIG. 16.

Note that steps S81 through S83, steps S83 through S87 which are performed if it is judged in step S83 that the paper-pass width W is smaller than A4 vertical, steps S83 through S90 which are performed if it is judged in step S83 that the paper-pass width W is larger than A4 vertical, and steps S91 through S92 in the flow of the present subroutine, are the same as steps S31 through S33, steps S33 through S37 which are performed if it is judged in step S33 that the paper-pass width W is smaller than A4 vertical, and steps S33 through S39 which are performed if it is judged in step S33 that the paper-pass width W is larger than A4 vertical, and steps S40 through S41, in the flow of arch cores displacement control in Embodiment 2 shown in FIG. 19, respectively, and description thereof is omitted here.

If it is judged in step S83 that the paper-pass width W is equal to A4 vertical, it is judged in what stage the arrangement of the arch cores 532 is (step S83: W=A4 vertical, step S85).

If it is judged that the arrangement of the arch cores 532 is lower than the third stage, the motor rotation control unit 45 is instructed to forward the arrangement of the arch cores 532 one stage, and it is judged whether or not the count of the arch core timer has reached the set time (step S85: <3rd, step S88, step S91).

If it is judged that the arrangement of the arch cores 532 is in the third stage, it is judged whether or not the count of the arch core timer has reached the set time (step S85: 3rd, step S91).

If it is judged that the arrangement of the arch cores 532 is higher than the third stage, the motor rotation control unit 45 is instructed to return the arrangement of the arch cores 532 one stage, and it is judged whether or not the count of the arch core timer has reached the set time (step S85: 3rd<, step S89, step S91).

With the above structure, when A4-vertical recording sheets are passed through continuously, the arrangement of the arch cores 532 can be forwarded or returned one stage by one stage so that the stage can be changed gradually to the third stage.

Up to now, the arch cores displacement control in the present modification has been described, taking, as an example, the case where the structure of the present modification is applied to Embodiment 2. However, not limited to this, the structure of the present modification is applied to Embodiment 3 or 4.

Figure 23:
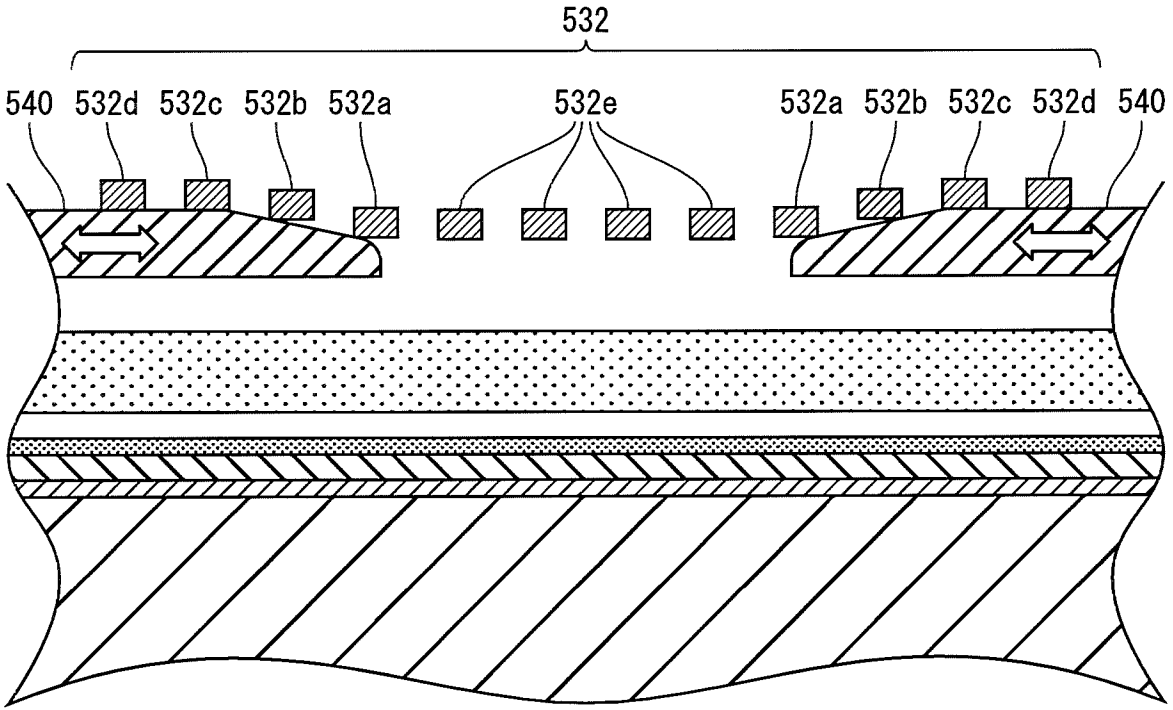
FIG. 23 is a partial cross sectional view of illustrating the structure of an arch cores displacement mechanism in Modification 2 of the present invention.

(2) In the above embodiments and modification, the arch cores 532 are displaced in sequence by rotating the rotation shaft 537 on whose circumferential surface the cams 538 are provided to be in contact with the arch cores 532. However, the mechanism for displacing the arch cores 532 in sequence is not limited to those structures. For example, as shown in FIG. 23, wedge-shaped members 540 each having a slant surface configured to contact with the arch cores 532 are inserted between the arch cores 532 and the coil bobbin 535 from both ends toward the center in the axis direction (width direction) of the fixing roller 51, and the wedge-shaped members 540 are moved along the axis to displace the arch cores 532 in sequence.

(3) In the above embodiments and modifications, the recording sheet S is passed through with reference to the center of the fixing roller 51 in the width direction (hereinafter, the method is referred to as "center paper-pass"). However, not limited to this, the recording sheet S may be passed through with reference to one end (hereinafter referred to as "end A") of the fixing roller 51 in the width direction (hereinafter, the method is referred to as "one-end paper-pass").

In the one-end paper-pass, the end A includes the minimum paper-pass area and is the paper-pass-through part, and the other end (hereinafter referred to as "end B") of the fixing roller 51 in the width direction is the non-paper-pass-through part. As a result, if the arch cores 532 provided on the end A side are fixed not to be displaced and the arch cores 532 provided on the end B side are displaced, it is possible to prevent the non-paper-pass-through part from being overheated.

(4) In the above embodiments and modifications, the number of arch cores 532 is "12". However, the number of arch cores 532 is not limited to "12", but may be a number that is greater than or smaller than "12". However, it is preferable that there are at least three (3) arch cores 532 corresponding to the large-size, small-size, and A4-vertical recording sheets.

Also, the number of arch cores 532 that are to be displaced is not limited to four (4) at either end in the axis direction of the fixing roller 51. The number of arch cores 532 that are to be displaced may be increased or decreased depending on the total number of the arch cores 532. Alternatively, the number of arch cores 532 that are to be displaced may be increased or decreased depending on the paper-pass width of the recording sheet to be passed through, which may be very small compared with the size of the recording sheet that is expected to be used most frequently in the office, such as the postcard size or business card size, or may be very large, such as the poster size.

(5) In the above embodiments and modifications, the control of the current supply to the exciting coil 531 is performed based on the result of judgment on whether or not the temperature T1 detected by the center temperature sensor 71 is higher than 180° C. However, the fixing temperature based on which the current supply is controlled is not limited to 180° C. That is to say, the fixing temperature may be set to any temperature depending on the type of recording sheet or toner to be used, or depending on whether or not the recording sheet is glossy, as long as it does not cause a fixing defect.

(6) In Embodiment 1, the arch cores displacement control forwards or returns the arrangement of the arch cores 532 one stage depending on whether the temperature T2 detected by the end temperature sensor 72 is equal to or higher than 181° C., or equal to or lower than 179° C. However, the temperature T2 based on which the arrangement of the arch cores is changed is not limited to 179° C. and 181° C. That is to say, the temperature T2 may be set to any temperature in a range that does not cause a fixing defect or overheating.

Furthermore, the temperatures T1 and T2 may be set to an equal value according to the circumstances.

(7) In Embodiments 2 through 4, the A4 vertical size is set as the standard, and it is judged whether a paper-pass width is larger than, smaller than, or equal to the A4 vertical size, and the stage of the arrangement of the arch cores 532 is changed depending on the result of the judgment. However, the standard for the paper-pass width is not limited to the A4 vertical size.

Also, instead of making the judgment based on a predetermined size of a predetermined sheet in the width direction (paper-pass width), such as A4 vertical, the size in the width direction of the current sheet may be compared with the size in the width direction of a sheet having been passed through immediately before, and if the current size is smaller than the previous one, the arch cores 532 are displaced in sequence in a direction moving away from the electromagnetic induction heating layer 514, in an order from the arch cores located furthest from the paper-pass area of the immediately passed-through recording sheet in the width direction (first control); and if the current size is larger than the previous one, the arch cores 532 are displaced in sequence in a direction approaching the electromagnetic induction heating layer 514, in an order from the arch cores located closest to the paper-pass area of the immediately passed-through recording sheet in the width direction (second control).

(8) In the above embodiments and modifications, each time the arrangement of the arch cores 532 is forwarded or returned one stage, not only a pair of arch cores 532, but also some of the remaining arch cores 532 are displaced as well, to some extent. For example, as shown in FIG. 8, when the arrangement of the arch cores 532 is forwarded from the first stage to the second stage, the arch cores 532*d* are displaced to the distant position, and the adjacent arch cores 532*c* are each displaced to a position in the middle of the closest position and the distant position.

However, not limited to the above structure, for each one-stage displacement, only a pair of arch cores 532 may be displaced, and the remaining arch cores 532 may stand still. In either case, each time the arrangement of the arch cores 532 is forwarded or returned one stage, the arch cores 532 are in sequence displaced toward the distant position or the closest position, in an order from the arch cores located at ends or at the center of the fixing roller 51 in the axis direction (width direction) of the fixing roller.

Note that in the present invention, the term "in sequence" is used to indicate the displacement of arch cores, including both of two cases: a case where, for each one-stage displacement, only a pair of arch cores (an arch core in the case of the one-end paper-pass) is displaced, as in the above description; and a case where, for each one-stage displacement, two or more pairs of arch cores (two or more arch cores in the case of the one-end paper-pass) are displaced as one move unit, as in the above embodiments and modifications.

(9) In the above embodiments and modifications, the fixing roller 51 is described as one example of the heat rotation body provided with the electromagnetic induction heating layer. However, not limited to this, for example, the electromagnetic induction heating layer may be provided, not in the fixing roller 51, but in a fixing belt located outside the fixing roller 51 so that the fixing belt functions as the heat rotation body, and the pressing roller 52 is caused to press the fixing roller 51 from outside thereof via the fixing belt to form the fixing nip 55 between the surface of the fixing belt and pressing roller 52, and the fixing belt is heated by the flux generated by the flux generator 53 in the electromagnetic induction heating.

(10) In Embodiment 4 described above, if it is judged that there is an image print signal for a recording sheet waiting to be printed after five recording sheets, a judgment on a paper-pass width of the recording sheet for which the image print signal is to be executed is made, and the arrangement of the arch cores 532 is changed in accordance with the paper-pass width determined by this judgment. However, this judgment is not limited to the above. The judgment may be made on the size of a recording sheet waiting to be printed after four (4) or less sheets or six (6) or more sheets as far as images are fixed onto the recording sheets of the number appropriately.

(11) In Embodiments 2 through 4 described above, the change of the arrangement of the arch cores 532 by one stage is performed while the image forming operation is performed once (as one example of a predetermined number of times when the image forming operation is performed). However, not limited to this, the change of the arrangement of the arch cores 532 by one stage may be performed while the image forming operation is performed twice or more for recording sheets of the same paper-pass width if a lot of recording sheets are passed through continuously.

Figure 24A:
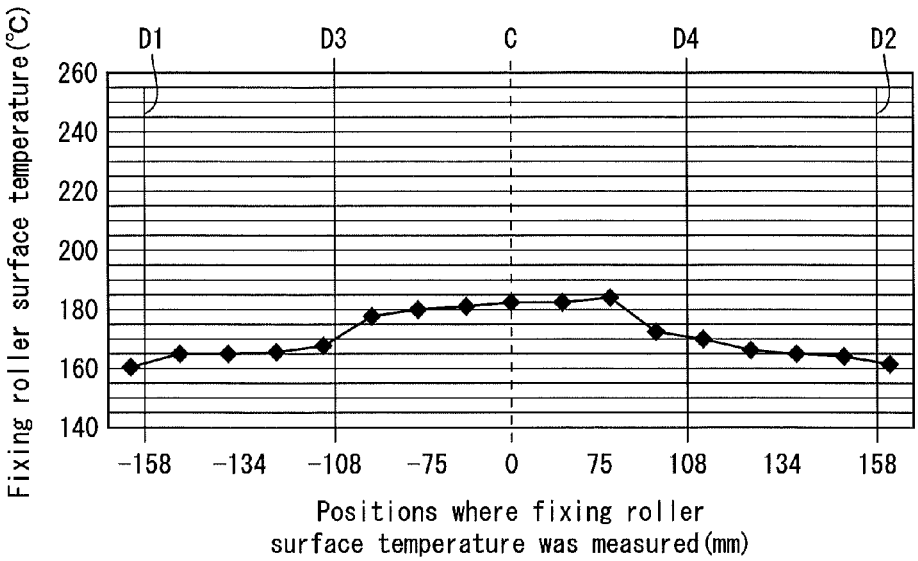
FIGS. 24A and 24B are graphs showing the temperature distribution on the surface of the fixing roller 51 in the axis direction (width direction) thereof when an arch cores displacement control in Modification 11 of the present invention was performed.
Figure 24B:
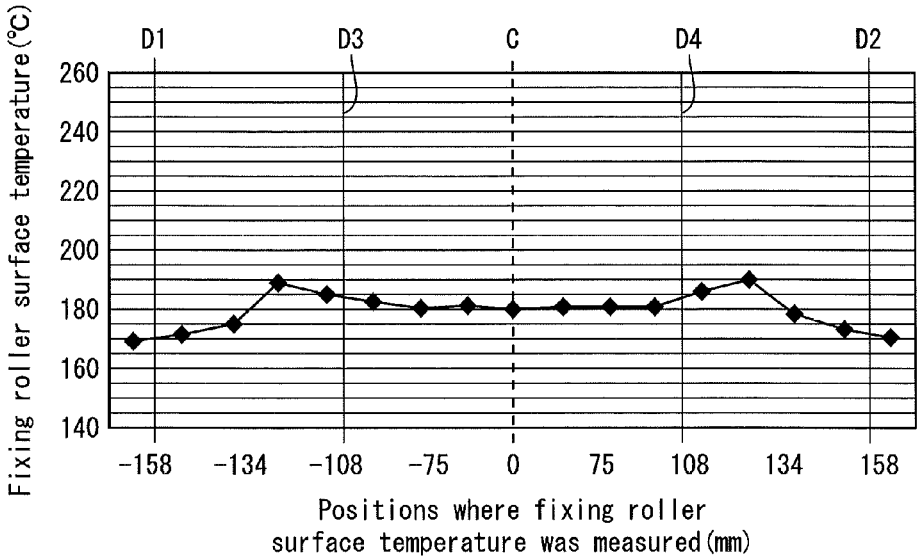

For example, the arrangement of the arch cores 532 may be changed one stage while 10 recording sheets are passed through. FIGS. 24A and 24B are graphs showing the temperature distribution on the surface of the fixing roller 51 in the axis direction (width direction) thereof when the arrangement of the arch cores 532 was changed two stages from the first stage to the third stage when a recording sheet of A4 vertical was passed through after 100 recording sheets of A4 horizontal had been passed through. The change of the arrangement of the arch cores 532 had been set so that the change of the arrangement of the arch cores 532 is started when the $80^{th}$ recording sheet of A4 horizontal starts to be passed through, and the change of the arrangement of the arch cores 532 is ended when the $100^{th}$ recording sheet of A4 horizontal ends to be passed through. FIG. 24A shows the temperature distribution on the surface of the fixing roller 51 when the change of the arrangement of the arch cores 532 was started; and FIG. 24B shows the temperature distribution on the surface of the fixing roller 51 when the change of the arrangement of the arch cores 532 was ended. In FIGS. 24A and 24B, the vertical axis represents the surface temperature of the fixing roller 51, and the horizontal axis represents the temperature measuring positions in the axis direction of the fixing roller 51. The temperature measuring positions in the horizontal axis are indicated as distances ([mm]) from the center (dotted line C) of the fixing roller 51 in the axis direction (width direction) thereof, the center being set as the standard (0 [mm]). The distance between the straight lines D1 and D2 represents the paper-pass area of the A4 horizontal, and the distance between the straight lines D3 and D4 represents the paper-pass area of the A4 vertical.

When the $100^{th}$ recording sheet of A4 horizontal was passed through, the arrangement of the arch cores 532 was in the third stage which corresponds to when a recording sheet of A4 vertical is passed through. However, as shown in FIG. 24B, the surface temperatures of the fixing roller 51 at the measuring points in the paper-pass area of the A4 horizontal were all in a range between 170° C. and 190° C., the range having been proved not to cause any problem with regard to the fixing ability. It is apparent from this that there is no problem with regard to the fixing ability even if the arrangement of the arch cores 532 is changed two stages while 20 recording sheets are passed through, the change of the arrangement of the arch cores 532 having been started 20 sheets earlier.

Accordingly, when a lot of recording sheets are to be passed through, the surface temperature of the fixing roller 51 can be controlled as follows. That is to say, the change of the arrangement of the arch cores 532 is started earlier so that the change of the arrangement of the arch cores can be fulfilled over a long time period, allowing the surface temperature of the fixing roller 51 to be changed more moderately, restricting an occurrence of an inadvertent fixing temperature shortage or excess, and so that, by the time the next recording sheet is passed through, a fixing temperature distribution that is suited for the next recording sheet is provided.

Note that with regard to the displacement of the arch cores in the present modification, the arrangement of the arch cores may be changed gradually one stage by one stage while a predetermined number of recording sheets are passed through as explained above, or may be changed one stage swiftly each time a predetermined number of recording sheets are passed through.

(12) In the above embodiments and modifications, the developing device and the image forming apparatus of the present invention are applied to a tandem color digital printer. However, not limited to this, the present invention is applicable to any image forming apparatus regardless of whether it is for monochrome images or color images, or whether it is a copier, printer, facsimile machine, or multi-function machine having these functions such as an MFP (Multiple Function Peripheral), as far as it is provided with a developing device of the electromagnetic induction heating method.

The present invention may be any possible combination of the above-described embodiments and modifications.

The characteristics and effects of the present invention are summarized as follows.

One aspect of the present invention a fixing device for thermally fixing an unfixed image onto a recording sheet by causing the recording sheet, with the unfixed image formed thereon, to pass through a fixing nip, while heating an electromagnetic induction heating layer provided in a heating rotation body by a flux generated by a flux generator including an exciting coil located a distance away from a circumferential surface of the heating rotation body along a width direction of the heating rotation body, the flux generator including: a plurality of magnetic cores arranged to be separated from each other in the width direction, to face the heating rotation body via the exciting coil; a holder configured to hold, among the plurality of magnetic cores, predetermined magnetic cores in a displaceable state where the magnetic cores can be displaced in a direction in which a distance from the heating rotation body changes, the predetermined magnetic cores being arranged in correspondence with a non-paper-pass area of the heating rotation body through which a sheet of a predetermined size does not pass; a displacement unit configured to displace the predetermined magnetic cores in a predetermined move unit, the predetermined move unit being a unit of one magnetic core or a unit of a predetermined number of consecutively placed magnetic cores; and a controller configured to control the displacement unit to displace the predetermined magnetic cores in sequence in the predetermined move unit.

With the above structure, it is possible to displace displacement-target arch cores in sequence, instead of displacing them all at once by the same amount. This prevents an abrupt change in the amount of heat generated in the heating layer, preventing a significant nonuniformity in temperature distribution and insufficient fixing temperature from occurring, and maintains an excellent fixing performance.

In the above fixing device, the displacement unit may displace, in the predetermined move unit, the predetermined magnetic cores within a range between a first position and a second position, the first position being equal to a distance between the heating rotation body and magnetic cores except for the predetermined magnetic cores among the plurality of magnetic cores, and the second position being further away from the heating rotation body than the first position.

With the above structure, it is possible to move magnetic cores arranged in correspondence with the non-paper-pass area further away from the heating rotation body than magnetic cores arranged in correspondence with the paper-pass area, thereby increasing the length of the magnetic path in the non-paper-pass area to increase the magnetic resistance. This reduces the amount of heat generated in the heating layer at a position corresponding to the non-paper-pass area, preventing the non-paper-pass area from overheating.

In the above fixing device, the displacement unit may include: a rotation shaft extending along the width direction of the heating rotation body; and a plurality of eccentric cams attached to the rotation shaft, the plurality of eccentric cams being shifted from each other in a rotational direction of the rotation shaft in position of long diameter, in the predetermined move unit of the magnetic cores, so that when the eccentric cams rotate with a rotation of the rotation shaft, the predetermined magnetic cores receive a displacement action from the eccentric cams and are displaced in sequence in the predetermined move unit.

With the above structure, a simple mechanism composed of the rotation shaft and eccentric cams can be used to displace magnetic cores in sequence. This contributes to reduction in cost.

In the above fixing device, the rotational shaft may be made of a ferromagnetic material, and the eccentric cams are made of a nonmagnetic material.

With the above structure, the rotational shaft made of a ferromagnetic material constitutes a part of the magnetic path, enabling a more amount of flux to be guided from the flux generator to the heating layer. Also, when magnetic cores are in the distant position (the second position), nonmagnetic cams are present in the magnetic path between the magnetic cores and the heating layer, and the cams restrict the magnetic bonding force between the magnetic cores and the heating layer. This efficiently restricts the heating in the heating layer.

In the above fixing device, the plurality of magnetic cores may have been formed in a shape of an arch whose has been formed along a circumferential surface in a rotational direction of the heating rotation body, the rotation shaft having been arranged between the magnetic cores and the exciting coil along a straight line connecting each center of the magnetic cores, the rotation shaft functioning as a center core.

With the above structure, the rotational shaft made of a ferromagnetic material guides the flux generated by the exciting coil to the heating layer more efficiently, increasing the heating efficiency.

The above fixing device may further comprise a temperature detector configured to detect a surface temperature in the non-paper-pass area of the heating rotation body, wherein the controller controls the displacement unit to displace the predetermined magnetic cores in sequence in the predetermined move unit in accordance with a temperature detected by the temperature detector.

The above structure controls the amount of heat generated by the heating rotation body by displacing the magnetic cores in sequence, in accordance with the actual surface temperature at an end portion in the width direction in the non-paper-pass area. Thus with this structure, it is possible to prevent more accurately the non-paper-pass-through parts from being overheated.

In the above fixing device, when a temperature detected by the temperature detector is equal to or higher than a first threshold value, the controller may control the displacement unit to displace the predetermined magnetic cores in the predetermined move unit in sequence from the arch cores located furthest from the paper-pass area toward the second position, and when a temperature detected by the temperature detector is lower than a second threshold value which is lower than the first threshold value, the controller controls the displacement unit to displace the predetermined magnetic cores in the predetermined move unit in sequence from the arch cores closest to the paper-pass area toward the first position.

With the above structure, when the surface temperature of a non-paper-pass-through part of the heating rotation body is equal to or higher than the first threshold value, the heating of the heating rotation body is restricted gradually in an order from a part furthest from the paper-pass-through part; and when the surface temperature of a non-paper-pass-through part is lower than the second threshold value, the heating of the heating rotation body is promoted gradually in an order from a part closest to the paper-pass-through part. This enables the surface temperature of the non-paper-pass-through part of the heating rotation body to be maintained in a range between the first threshold value and the second threshold value. Also, this prevents an abrupt change in temperature on the surface of the heating rotation body, preventing an occurrence of a fixing failure due to insufficient fixing temperature, and preventing the non-paper-pass-through part from overheating.

The above fixing device may further comprise a first sheet size obtaining unit configured to obtain a size in the width direction of a sheet on which a thermal fixing is to be performed, wherein the controller controls the displacement unit to displace the predetermined magnetic cores in the predetermined move unit in accordance with the size in the width direction of the sheet obtained by the first sheet size obtaining unit, each time an image forming operation is performed a predetermined number of times onto sheets of the size in the width direction.

With this structure, instead of being newly provided with a temperature detector, such as a temperature sensor, for detecting the surface temperature of the non-paper-pass-through part of the heating rotation body, information of a sheet size is obtained and the magnetic cores are displaced in accordance with the obtained size. This contributes to reduction in cost.

In the above fixing device, if the size in the width direction of the sheet obtained by the first sheet size obtaining unit is smaller than a size in the width direction of a sheet having been passed through immediately before, the controller may perform a first control in which the controller controls the displacement unit to displace the predetermined magnetic cores in the predetermined move unit in sequence from the magnetic cores located furthest from the paper-pass area of the sheet having been passed through immediately before, among displaceable magnetic cores in the first position, toward the second position, and if the size in the width direction of the sheet obtained by the first sheet size obtaining unit is larger than the size in the width direction of the sheet having been passed through immediately before, the controller may perform a second control in which the controller controls the displacement unit to displace magnetic cores in the predetermined move unit in sequence from the magnetic cores located closest to the paper-pass area of the sheet having been passed through immediately before, toward the first position.

With the above structure, when a plurality of sheets different in size are passed through consecutively and a sheet larger in size than the preceding sheet is passed through, an area having a large amount of heat is increased; and when a sheet smaller in size than the preceding sheet is passed through, an area having a large amount of heat is reduced. This prevents the non-paper-pass area from overheating.

In the above fixing device, if the size in the width direction of the sheet obtained by the first sheet size obtaining unit is larger than a predetermined size in the width direction of a predetermined sheet, the controller may perform a third control in which the controller controls the displacement unit to displace all at once magnetic cores that correspond to the paper-pass area of the size and are in the second position, to the first position, after a fixing is performed onto a first predetermined number of sheets of the size.

With the above structure, the displacement of the magnetic cores is not performed if there is no need to do so thanks to the residual heat. This reduces the frequency of performing the displacement of the magnetic cores, and thus reduces a feeling of discomfort of the user in the case where the user feels discomfort with the sound emitted when the magnetic cores are displaced. This also restricts the power consumption.

In the above fixing device, if the size in the width direction of the sheet obtained by the first sheet size obtaining unit is equal to a predetermined size in the width direction, the controller may perform a fourth control in which the controller controls the displacement unit to displace (i) magnetic cores not in the second position, among displaceable magnetic cores corresponding to the non-paper-pass area of the size in the width direction of the sheet obtained by the first sheet size obtaining unit, all at once to the second position, or (ii) magnetic cores in the second position, among displaceable magnetic cores corresponding to the paper-pass area of the size in the width direction of the sheet obtained by the first sheet size obtaining unit, all at once toward the first position, so that, among the predetermined magnetic cores held in the displaceable state, only magnetic cores currently corresponding to the non-paper-pass area of the size in the width direction are present at the second position.

With the above structure, if the sheet size is equal to a predetermined size in the width direction, which may be, for example, a sheet size expected to be used most frequently, the magnetic cores can be displaced quickly toward a position which is appropriate for a fixing temperature for a sheet of the predetermined size in the width direction. This makes it possible to realize an excellent fixing with certainty for the sheet of the predetermined size in the width direction.

The above fixing device may further comprise a second sheet size obtaining unit configured to obtain a size in the width direction of a sheet to be transported for thermal fixing after a predetermined number of sheets, wherein the controller controls the displacement unit to displace the predetermined magnetic cores in the predetermined move unit in accordance with the size in the width direction of the sheet obtained by the second sheet size obtaining unit.

With the above structure, when a plurality of sheets different in size are passed through consecutively, an appropriate fixing temperature for each size can be provided starting with the first sheet in each size.

In the above fixing device, if the size in the width direction of the sheet obtained by the second sheet size obtaining unit is smaller than a predetermined size, the controller may control the displacement unit to displace the predetermined magnetic cores in the predetermined move unit in sequence from the magnetic cores located furthest from the paper-pass area toward the second position, and if the size in the width direction of the sheet obtained by the second sheet size obtaining unit is larger than the predetermined size, or the number of sheets to be transported for thermal fixing is lower than a second predetermined number, the controller may control the displacement unit to displace magnetic cores in the predetermined move unit in sequence from the magnetic cores located closest to the paper-pass area to the first position.

With the above structure, when a plurality of sheets different in size are passed through consecutively, the magnetic cores are displaced gradually in advance so that an appropriate fixing temperature distribution can be provided. This prevents an abrupt change in temperature on the surface of the heating rotation body, preventing an occurrence of an extremely nonuniform fixing temperature distribution, and providing an appropriate fixing temperature for each size starting with the first sheet in each size.

In the above fixing device, the nonmagnetic material may be a heat-resistant resin.

With the above structure, even if the cams are used in high temperature in the fixing device, it is less likely for the cams to be deformed or deteriorated. This makes it possible to displace the magnetic cores by the cams in a stable manner.

In the above fixing device, the heat-resistant resin may be selected from the group consisting of PI (polyimide), PEEK (polyetheretherketone), and PPS (polyphenylenesulfide), or one of combinations thereof.

With the above structure, it is possible to use a general-purpose, heat-resistant material to form the cams. This provides an easier manufacturing and contributes to reduction in cost.

Another aspect of the present invention provides an image forming apparatus comprising the fixing device having the above characteristics.

The above structure provides the same effects as the above structure of fixing device.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A fixing device for thermally fixing an unfixed image onto a recording sheet by causing the recording sheet, with the unfixed image formed thereon, to pass through a fixing nip, while heating an electromagnetic induction heating layer provided in a heating rotation body by a flux generated by a flux generator including an exciting coil located a distance away from a circumferential surface of the heating rotation body along a width direction of the heating rotation body, the flux generator including:

a plurality of magnetic cores arranged to be separated from each other in the width direction, to face the heating rotation body via the exciting coil;

a holder configured to hold, among the plurality of magnetic cores, predetermined magnetic cores in a displaceable state where the magnetic cores can be displaced in a direction in which a distance from the heating rotation body changes, the predetermined magnetic cores being arranged in correspondence with a non-paper-pass area of the heating rotation body through which a sheet of a predetermined size does not pass;

a displacement unit configured to displace the predetermined magnetic cores in a predetermined move unit, the predetermined move unit being a unit of one magnetic core or a unit of a predetermined number of consecutively placed magnetic cores; and a controller configured to control the displacement unit to displace the predetermined magnetic cores in sequence in the predetermined move unit.

2. The fixing device of claim 1, wherein the displacement unit displaces, in the predetermined move unit, the predetermined magnetic cores within a range between a first position and a second position, the first position being equal to a distance between the heating rotation body and magnetic cores except for the predetermined magnetic cores among the plurality of magnetic cores, and the second position being further away from the heating rotation body than the first position.

3. A fixing device of claim 1, wherein the displacement unit includes:

a rotation shaft extending along the width direction of the heating rotation body; and a plurality of eccentric cams attached to the rotation shaft, the plurality of eccentric cams being shifted from each other in a rotational direction of the rotation shaft in position of long diameter, in the predetermined move unit of the magnetic cores, so that when the eccentric cams rotate with a rotation of the rotation shaft, the predetermined magnetic cores receive a displacement action from the eccentric cams and are displaced in sequence in the predetermined move unit.

4. The fixing device of claim 3, wherein the rotation shaft is made of a ferromagnetic material, and the eccentric cams are made of a nonmagnetic material.

5. The fixing device of claim 4, wherein the plurality of magnetic cores have been formed in a shape of an arch whose has been formed along a circumferential surface in a rotational direction of the heating rotation body, the rotation shaft having been arranged between the magnetic cores and the exciting coil along a straight line connecting each center of the magnetic cores, the rotation shaft functioning as a center core.

6. A fixing device of claim 1 further comprising a temperature detector configured to detect a surface temperature in the non-paper-pass area of the heating rotation body, wherein the controller controls the displacement unit to displace the predetermined magnetic cores in sequence in the predetermined move unit in accordance with a temperature detected by the temperature detector.

7. The fixing device of claim 6, wherein when a temperature detected by the temperature detector is equal to or higher than a first threshold value, the controller controls the displacement unit to displace the predetermined magnetic cores in the predetermined move unit in sequence from the arch cores located furthest from the paper-pass area toward the second position, and when a temperature detected by the temperature detector is lower than a second threshold value which is lower than the first threshold value, the controller controls the displacement unit to displace the predetermined magnetic cores in the predetermined move unit in sequence from the arch cores closest to the paper-pass area toward the first position.

8. The fixing device of claim 1 further comprising a first sheet size obtaining unit configured to obtain a size in the width direction of a sheet on which a thermal fixing is to be performed, wherein the controller controls the displacement unit to displace the predetermined magnetic cores in accordance with the size in the width direction of the sheet obtained by the first sheet size obtaining unit, each time an image forming operation is performed a predetermined number of times onto sheets of the size in the width direction.

9. The fixing device of claim 8, wherein if the size in the width direction of the sheet obtained by the first sheet size obtaining unit is smaller than a size in the width direction of a sheet having been passed through immediately before, the controller performs a first control in which the controller controls the displacement unit to displace the predetermined magnetic cores in sequence from the magnetic cores located furthest from the paper-pass area of the sheet having been passed through immediately before, among displaceable magnetic cores in the first position, toward the second position, and if the size in the width direction of the sheet obtained by the first sheet size obtaining unit is larger than the size in the width direction of the sheet having been passed through immediately before, the controller performs a second control in which the controller controls the displacement unit to displace magnetic cores in sequence from the magnetic cores located closest to the paper-pass area of the sheet having been passed through immediately before, toward the first position.

10. The fixing device of claim 9, wherein if the size in the width direction of the sheet obtained by the first sheet size obtaining unit is larger than a predetermined size in the width direction of a predetermined sheet, the controller performs a third control in which the controller controls the displacement unit to displace all at once magnetic cores that correspond to the paper-pass area of the size and are in the second position, to the first position, after a fixing is performed onto a first predetermined number of sheets of the size.

11. The fixing device of claim 9, wherein if the size in the width direction of the sheet obtained by the first sheet size obtaining unit is equal to a predetermined size in the width direction, the controller performs a fourth control in which the controller controls the displacement unit to displace (i) magnetic cores not in the second position, among displaceable magnetic cores corresponding to the non-paper-pass area of the size in the width direction of the sheet obtained by the first sheet size obtaining unit, all at once to the second position, or (ii) magnetic cores in the second position, among displaceable magnetic cores corresponding to the paper-pass area of the size in the width direction of the sheet obtained by the first sheet size obtaining unit, all at once toward the first position, so that, among the predetermined magnetic cores held in the displaceable state, only magnetic cores currently corresponding to the non-paper-pass area of the size in the width direction are present at the second position.

12. The fixing device of claim 8 further comprising a second sheet size obtaining unit configured to obtain a size in the width direction of a sheet to be transported for thermal fixing after a predetermined number of sheets, wherein the controller controls the displacement unit to displace the predetermined magnetic cores in the predetermined move unit in accordance with the size in the width direction of the sheet obtained by the second sheet size obtaining unit.

13. The fixing device of claim 12, wherein if the size in the width direction of the sheet obtained by the second sheet size obtaining unit is smaller than a predetermined size, the controller controls the displacement unit to displace the predetermined magnetic cores in sequence from the magnetic cores located furthest from the paper-pass area toward the second position, and if the size in the width direction of the sheet obtained by the second sheet size obtaining unit is larger than the predetermined size, or the number of sheets to be transported for thermal fixing is lower than a second predetermined number, the controller controls the displacement unit to displace magnetic cores in sequence from the magnetic cores located closest to the paper-pass area to the first position.

14. The fixing device of claim 4, wherein the nonmagnetic material is a heat-resistant resin.

15. The fixing device of claim 14, wherein the heat-resistant resin is selected from the group consisting of PI (polyimide), PEEK (polyetheretherketone), and PPS (polyphenylenesulfide), or one of combinations thereof.

16. An image forming apparatus comprising the fixing device defined in claim 1.

17. The fixing device of claim 1, wherein:

a first group of the plurality of magnetic cores is arranged in a central section in the width direction;

the displacement unit is configured to displace the predetermined magnetic cores in a direction in which a distance of the magnetic core from the heating rotation body changes; and the controller is configured to control the displacement unit to displace the predetermined magnetic cores in sequence such that a second group of the plurality of magnetic cores that is arranged on each side of the first group in the width direction is moved a first distance from the heating rotation body, and a third group of the plurality of magnetic cores that is arranged outside of the first and second groups in the width direction is moved, simultaneously with the second group, a second distance from the heating rotation body, wherein the second distance is greater than the first distance.

18. A flux generator for a fixing device for thermally fixing an unfixed image onto a recording sheet by causing the recording sheet, with the unfixed image formed thereon, to pass through a fixing nip, while heating an electromagnetic induction heating layer provided in a heating rotation body by a flux generated by the flux generator, the flux generator comprising:

an exciting coil located a distance away from a circumferential surface of the heating rotation body along a width direction of the heating rotation body, a plurality of magnetic cores arranged to be separated from each other in the width direction, to face the heating rotation body via the exciting coil;

a holder configured to hold, among the plurality of magnetic cores, predetermined magnetic cores in a displaceable state where the magnetic cores can be displaced in a direction in which a distance from the heating rotation body changes, the predetermined magnetic cores being arranged in correspondence with a non-paper-pass area of the heating rotation body through which a sheet of a predetermined size does not pass;

a displacement unit configured to displace the predetermined magnetic cores in a predetermined move unit, the predetermined move unit being a unit of one magnetic core or a unit of a predetermined number of consecutively placed magnetic cores; and a controller configured to control the displacement unit to displace the predetermined magnetic cores in sequence in the predetermined move unit.

19. A fixing device for thermally fixing an unfixed image onto a recording sheet by causing the recording sheet, with the unfixed image formed thereon, to pass through a fixing nip, while heating an electromagnetic induction heating layer provided in a heating rotation body by a flux generated by a flux generator including an exciting coil located a distance away from a circumferential surface of the heating rotation body along a width direction of the heating rotation body, the flux generator comprising:

a plurality of magnetic cores arranged separately from each other in the width direction, to face the heating rotation body via the exciting coil, wherein a first group of the plurality of magnetic cores is arranged in a central section in the width direction;

a holder configured to hold, among the plurality of magnetic cores, predetermined magnetic cores in a displaceable state where the magnetic cores can be displaced in a direction in which a distance from the heating rotation body changes, the predetermined magnetic cores being arranged in correspondence with a non-paper-pass area of the heating rotation body through which a sheet of a predetermined size does not pass;

a displacement unit configured to displace the predetermined magnetic cores in a direction in which a distance of the magnetic core from the heating rotation body changes; and a controller configured to control the displacement unit to displace the predetermined magnetic cores in sequence such that a second group of the plurality of magnetic cores that is arranged on each side of the first group in the width direction is moved a first distance from the heating rotation body, and a third group of the plurality of magnetic cores that is arranged outside of the first and second groups in the width direction is moved, simultaneously with the second group, a second distance from the heating rotation body, wherein the second distance is greater than the first distance.

* * * * *